US011476626B2

(12) United States Patent
Chien

(10) Patent No.: US 11,476,626 B2
(45) Date of Patent: Oct. 18, 2022

(54) DC POWERED REMOTE CONTROL LED LIGHT-BAR ASSEMBLY

(71) Applicant: Tseng-Lu Chien, Walnut, CA (US)

(72) Inventor: Tseng-Lu Chien, Walnut, CA (US)

(73) Assignees: Aaron Chien, Walnut, CA (US); Hsin-Yi Wang, Walnut, CA (US); Te-Ju Chien, Walnut, CA (US)

( * ) Notice: Subject to any disclaimer, the term of this patent is extended or adjusted under 35 U.S.C. 154(b) by 0 days.

(21) Appl. No.: 16/380,054

(22) Filed: Apr. 10, 2019

(65) Prior Publication Data

US 2019/0237924 A1 Aug. 1, 2019

Related U.S. Application Data

(60) Continuation-in-part of application No. 15/472,698, filed on Mar. 29, 2017, now abandoned, which is a (Continued)

(51) Int. Cl.
*H01R 33/06* (2006.01)
*F21Y 115/10* (2016.01)
(Continued)

(52) U.S. Cl.
CPC ..... *H01R 33/06* (2013.01); *F21V 7/0008* (2013.01); *F21Y 2107/90* (2016.08); *F21Y 2115/10* (2016.08)

(58) Field of Classification Search
CPC ..... F21V 7/0008; F21Y 2107/90; F21Y 2115/10; H01R 33/06
See application file for complete search history.

(56) References Cited

U.S. PATENT DOCUMENTS 3,143,035 A 8/1964 Morgan
3,539,798 A 11/1970 Perry
(Continued)

*Primary Examiner* — Tsion Tumebo
(74) *Attorney, Agent, or Firm* — Bacon & Thomas, PLLC

(57) ABSTRACT

The LED plug-in outlet or DC power light has LED-unit(s) to offer one or more than one near-by lighted-location(s) with preferred adjustable angle constriction and each of said LED-unit(s) has built-in plurality of the said dip or chip or dice or COB LED(s) to emit directly or in-directly LED light-beam from big surface of the said each of LED-unit(s) to supply consumer for one LED light offer one or more than one near-by lighted locations for desired or selected-functions, light color(s), brightness(s), light performance(s) while incorporate with circuitry, AC-to-DC circuit, IC, and control device select from sensor, motion sensor, photo sensor, radar sensor, sound sensor, power fail circuit, switch, IR or RF remote controller, blue-tooth, wireless controller, WI-FI with APP software to make setting or adjustment or selection to make the LED light to turn-on/off, fade-in and fade-out, high-low brightness, motion or non-motion selection, change functions from variety pre-programed functions to offer near-by locations which is less than 30 feet and brightness is less than 500 CD from each of the said LED unit(s). Wherein, the angle adjustment prefer to apply one of traditional skill or by magnetic reaction-force between loaded-battery or metal-piece built-in LED-unit(s) and holder base magnetic-piece(s) to adjust the angle for illumination. The LED light has trigger system to turn on and turn off the functions and optional to touch or push the top-lens to turn off the functions or LED illumination. The said LED-unit(s) or LED-bar assembly that is one of movable, extendable, transformable construction to offer more choice of light illuminations or more, bigger area(s) be illuminated. Also, have power saving and cost saving features.

15 Claims, 11 Drawing Sheets

Figure 1:
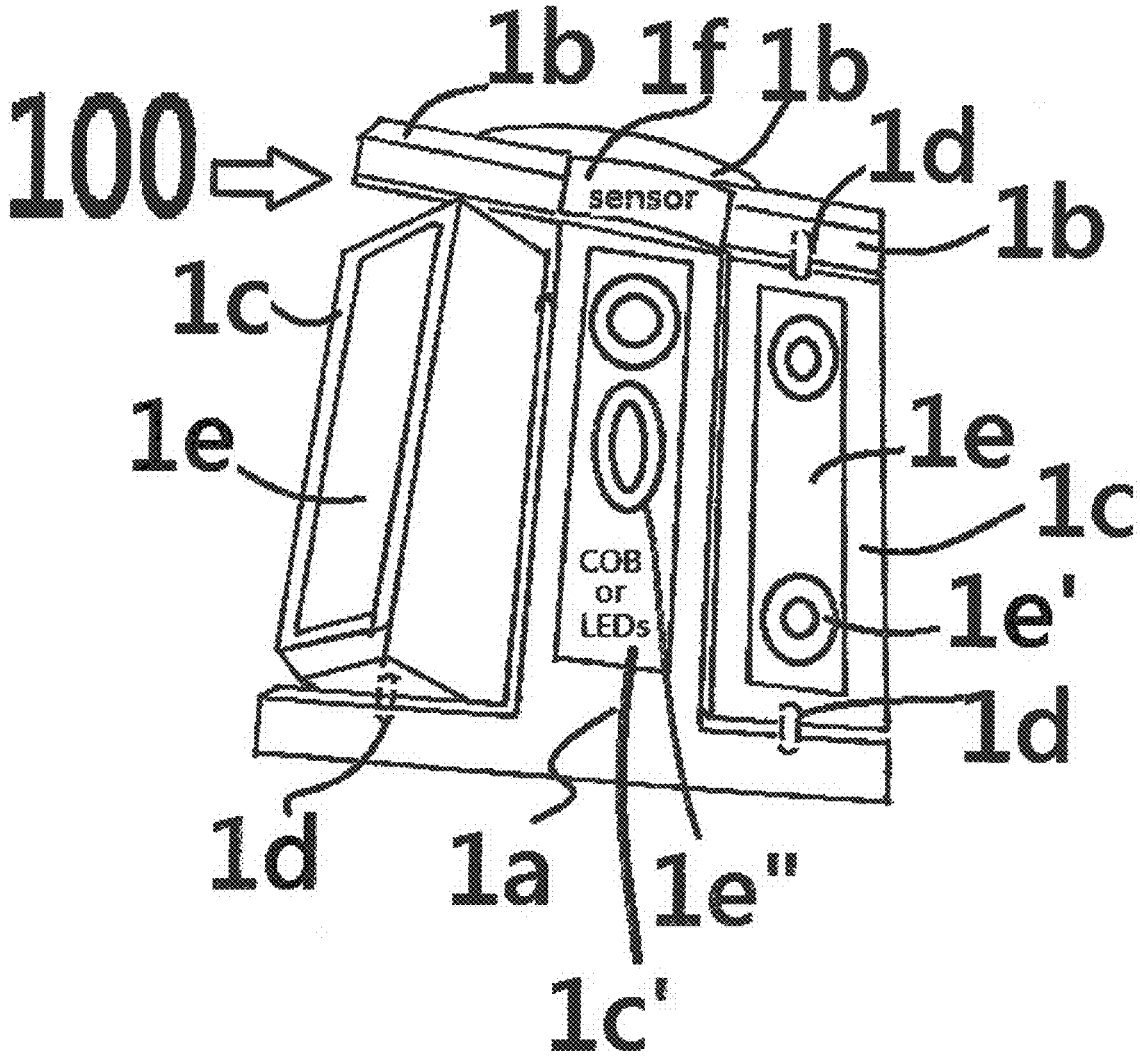

Related U.S. Application Data continuation-in-part of application No. 15/458,498, filed on Mar. 14, 2017, now Pat. No. 10,371,361, which is a continuation-in-part of application No. 13/367,687, filed on Feb. 7, 2012, now Pat. No. 9,625,134, which is a continuation-in-part of application No. 13/162,824, filed on Jun. 17, 2011, now Pat. No. 8,950,899, and a continuation-in-part of application No. 12/894,865, filed on Sep. 30, 2010, now Pat. No. 8,393,755, and a continuation-in-part of application No. 12/887,709, filed on Sep. 22, 2010, now abandoned, said application No. 15/458,498 is a continuation-in-part of application No. 13/367,816, filed on Feb. 7, 2012, now Pat. No. 8,944,669, and a continuation of application No. 12/938,628, filed on Nov. 3, 2010, now abandoned, application No. 16/380,054, which is a continuation-in-part of application No. 15/995,423, filed on Jun. 1, 2018, which is a division of application No. 14/968,250, filed on Dec. 14, 2015, now abandoned, which is a continuation-in-part of application No. 13/367,687, filed on Feb. 7, 2012, now Pat. No. 9,625,134, application No. 16/380,054, which is a continuation-in-part of application No. 12/834,435, filed on Jul. 12, 2010, now abandoned, which is a continuation of application No. 12/292,153, filed on Nov. 12, 2008, now Pat. No. 7,871,192.

(51) Int. Cl.
*F21Y 107/90* (2016.01)
*F21V 7/00* (2006.01)

(56) References Cited

U.S. PATENT DOCUMENTS 4,177,500 A 12/1979 Nicholl et al.
4,454,569 A * 6/1984 Maguire ..... F21S 2/005 362/127
4,538,214 A * 8/1985 Fisher ..... F21V 21/096 362/147
4,756,614 A 7/1988 Kato
5,154,509 A * 10/1992 Wulfman ..... F21V 21/096 362/227
5,218,388 A 6/1993 Purdy
5,268,829 A 12/1993 Lo
5,287,132 A 2/1994 Suzuki
5,321,449 A 6/1994 Coccoli
5,508,490 A 4/1996 Klose
5,517,264 A 5/1996 Sutton
5,535,230 A 7/1996 Abe
5,572,817 A 11/1996 Chien
5,667,737 A 9/1997 Chien
5,769,684 A 6/1998 Lou
5,842,761 A 12/1998 Futakami
5,926,440 A 7/1999 Chien
5,934,223 A 8/1999 Ellery-Guy
5,978,051 A 11/1999 Gohman
6,010,228 A 1/2000 Blackman et al.
6,072,606 A 6/2000 Huether et al.
6,199,999 B1 3/2001 Cotton, Jr.
6,350,042 B1 2/2002 Lai
6,351,077 B1 2/2002 Koyama
6,357,893 B1 * 3/2002 Belliveau ..... F21L 4/027 362/285
6,364,501 B1 4/2002 Tai
6,390,647 B1 5/2002 Shaefer
6,420,974 B1 7/2002 Baker et al.
6,477,453 B2 11/2002 Oi et al.
6,558,022 B2 5/2003 Kawahara
6,584,713 B2 7/2003 Huang
6,614,336 B2 * 9/2003 Galli ..... H01H 36/00 335/205
6,719,433 B1 4/2004 Belliveau
6,727,814 B2 4/2004 Saltzstein et al.
6,736,531 B2 5/2004 Wallach
6,864,496 B2 3/2005 Levine
6,923,551 B2 * 8/2005 Galli ..... H01H 36/00 224/420
6,965,205 B2 11/2005 Piepgras et al.
7,104,656 B2 9/2006 Dwyer
7,145,179 B2 * 12/2006 Petroski ..... F21V 21/096 257/81
7,267,444 B2 9/2007 Black, Jr.
7,303,327 B2 * 12/2007 Copeland ..... F21S 8/035 362/271
7,311,423 B2 * 12/2007 Frecska ..... F21V 14/02 362/372
7,390,092 B2 6/2008 Belliveau
7,455,444 B2 11/2008 Chien
7,527,389 B2 5/2009 Belliveau
7,543,955 B2 6/2009 Belliveau
7,600,891 B2 10/2009 Belliveau
7,600,892 B2 10/2009 Belliveau
7,712,926 B2 * 5/2010 Matheson ..... F21V 21/30 362/294
7,726,974 B2 * 6/2010 Shah ..... H05B 45/60 439/40
8,089,691 B2 1/2012 Arbuckle
8,184,445 B2 * 5/2012 Jacobs ..... H05B 47/18 361/760
8,303,150 B2 11/2012 Chien
8,328,368 B2 12/2012 Luciano
8,360,609 B2 * 1/2013 Lee ..... H05B 45/34 362/249.07
8,408,736 B2 4/2013 Chien
8,545,066 B2 * 10/2013 Coleman ..... F21V 21/145 362/421
8,657,464 B2 2/2014 Lundberg
8,879,782 B2 11/2014 Garlington
8,915,609 B1 * 12/2014 Shah ..... F21V 21/096 362/183
8,950,899 B2 * 2/2015 Chien ..... F21V 3/00 362/249.03
9,157,589 B2 10/2015 Chien
9,157,590 B2 10/2015 Burkard et al.
9,267,660 B1 2/2016 Wang
9,909,739 B2 3/2018 Chien
2002/0093296 A1 7/2002 Belliveau
2002/0101571 A1 8/2002 Panasewicz
2002/0152656 A1 10/2002 Huang
2002/0181234 A1 12/2002 Kawahara
2003/0117090 A1 6/2003 Belliveau
2003/0133292 A1 * 7/2003 Mueller ..... F21K 9/00 362/231
2003/0206415 A1 11/2003 Levine
2005/0174777 A1 8/2005 Cooper
2006/0002110 A1 * 1/2006 Dowling ..... H05B 47/155 362/249.05
2006/0022214 A1 * 2/2006 Morgan ..... H05B 45/3725 257/99
2006/0262544 A1 * 11/2006 Piepgras ..... F21V 29/763 362/373
2007/0035705 A1 2/2007 Hurd
2007/0152231 A1 * 7/2007 Destain ..... H01L 33/58 257/99
2008/0062681 A1 3/2008 Belliveau
2008/0062683 A1 3/2008 Belliveau
2008/0062684 A1 3/2008 Belliveau
2008/0062685 A1 3/2008 Belliveau
2008/0089060 A1 * 4/2008 Kondo ..... F21V 17/107 362/231
2008/0165531 A1 7/2008 Belliveau
2009/0027881 A1 1/2009 Belliveau
2009/0135373 A1 5/2009 Dreiblatt
2009/0279298 A1 * 11/2009 Mier-Langner .... H01R 13/6205 362/235

(56) References Cited

U.S. PATENT DOCUMENTS

| | | | | |
|---|---|---|---|---|
| 2010/0118555 | A1* | 5/2010 | Lee | F21K 9/278 362/418 |
| 2010/0157596 | A1* | 6/2010 | Wen | F21V 31/005 362/235 |
| 2010/0296285 | A1* | 11/2010 | Chemel | F21V 14/02 362/235 |
| 2011/0007496 | A1 | 1/2011 | Chien | |
| 2011/0285292 | A1* | 11/2011 | Mollnow | F21V 29/717 315/113 |
| 2012/0075857 | A1* | 3/2012 | Verbrugh | F21V 29/73 362/249.01 |
| 2013/0052761 | A1* | 2/2013 | Nishiwaki | H01L 33/0095 438/15 |
| 2013/0235555 | A1* | 9/2013 | Tanaka | F21V 3/08 362/84 |
| 2014/0049956 | A1* | 2/2014 | Manahan | F21V 23/04 362/233 |
| 2014/0175492 | A1* | 6/2014 | Steranka | H01L 33/44 257/98 |
| 2014/0186980 | A1* | 7/2014 | Igarashi | H01L 33/50 438/27 |
| 2015/0070938 | A1 | 3/2015 | Chien | |
| 2015/0276178 | A1 | 10/2015 | Chien | |
| 2016/0097499 | A1 | 4/2016 | Chien | |
| 2016/0097969 | A1 | 4/2016 | Sum | |
| 2016/0209013 | A1 | 7/2016 | Chien | |
| 2016/0215962 | A1 | 7/2016 | Chien | |
| 2016/0313636 | A1 | 10/2016 | Chien | |

* cited by examiner

500

600

Figures 7, 8:
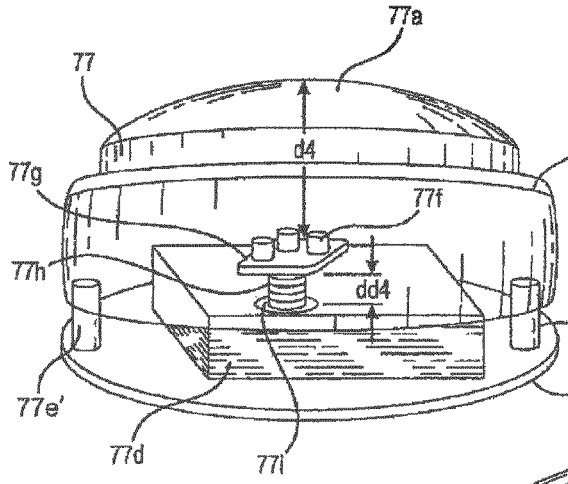

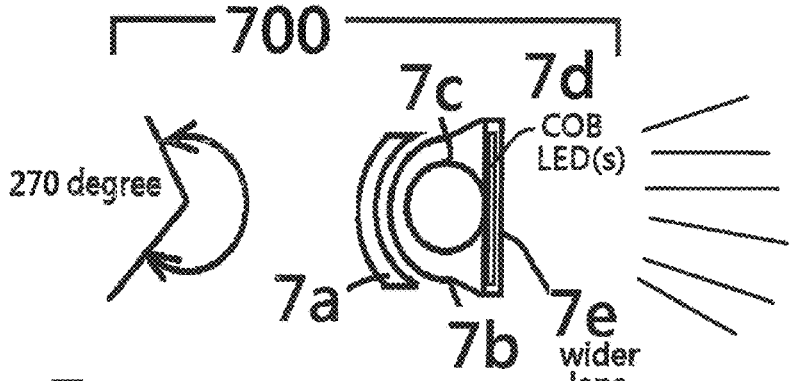
Fig. 7
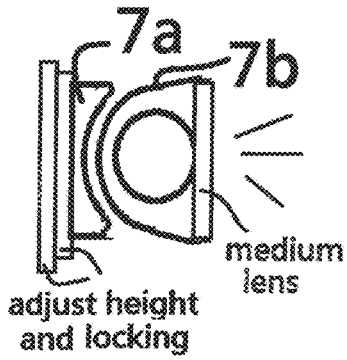
Fig.7A
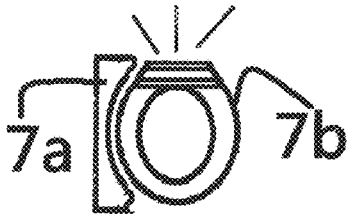
Fig.7B
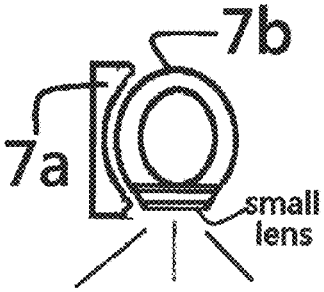
Fig.7C
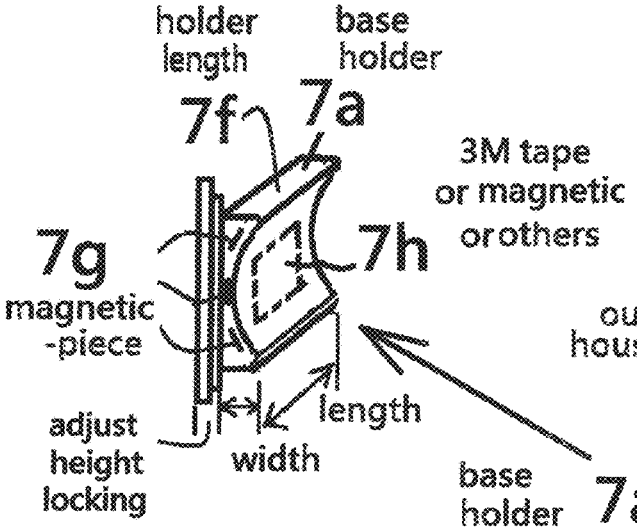
Fig.7D
Fig.7E
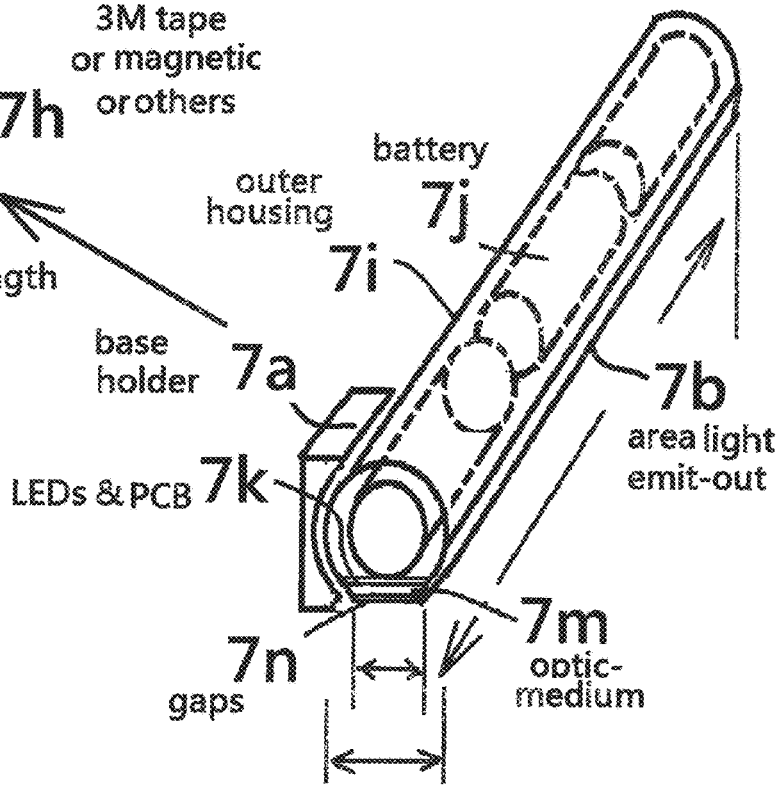

Figure 3:
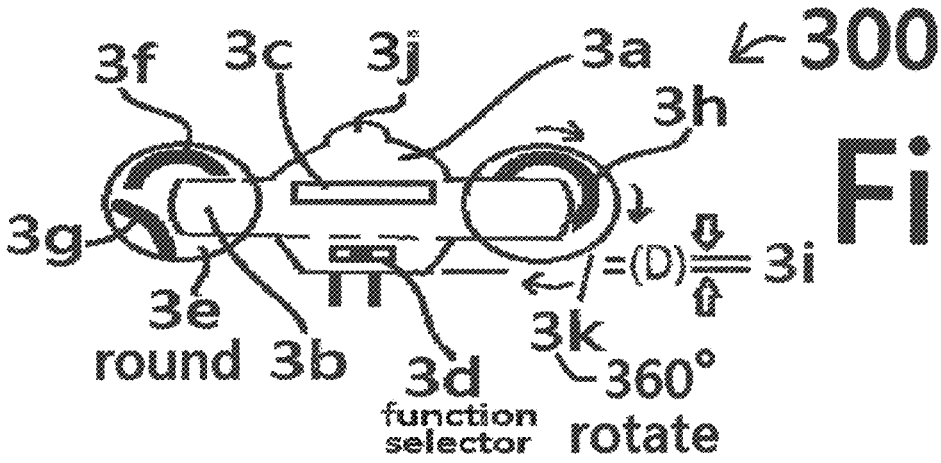

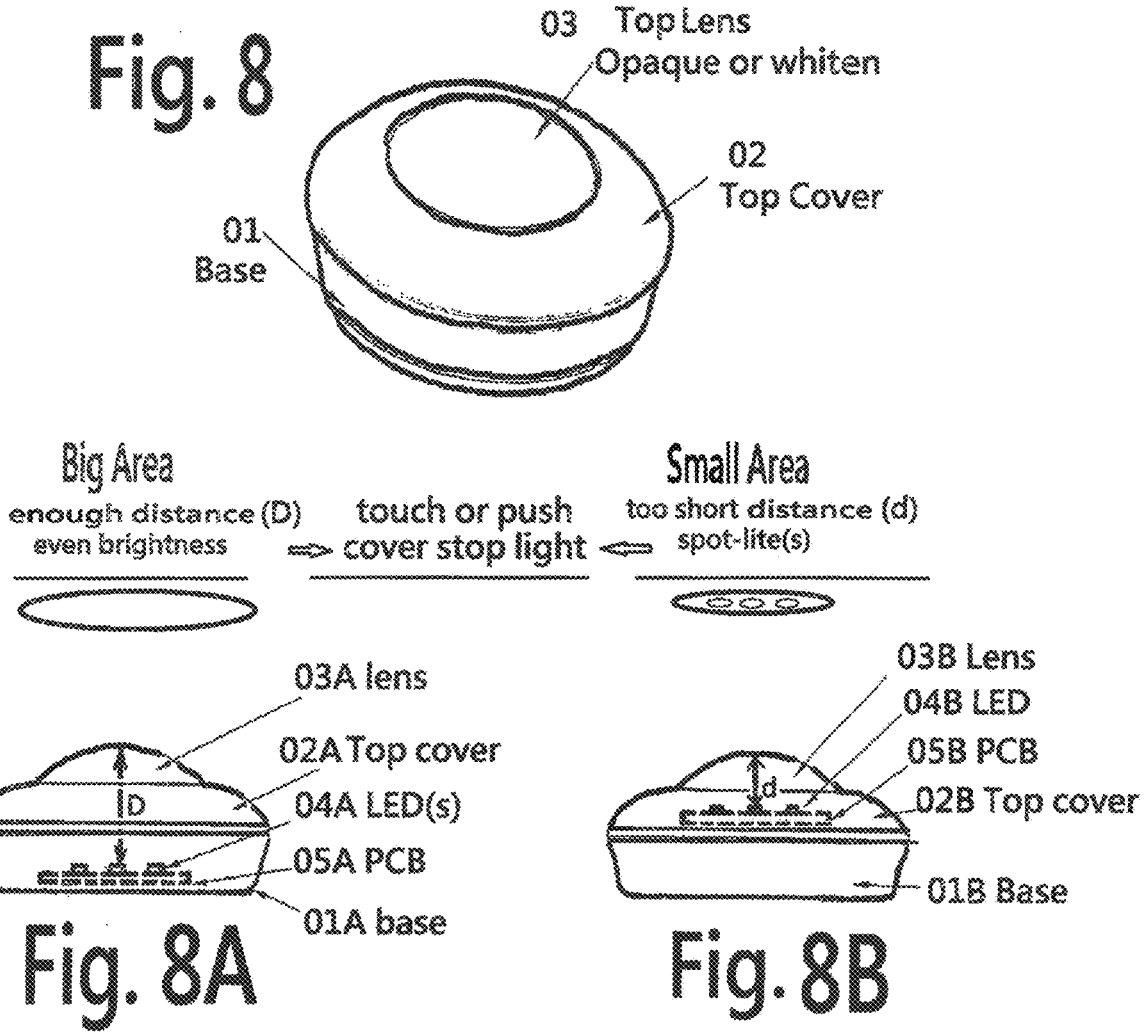
Fig. 8
03 Top Lens
Opaque or whiten
02
Top Cover
01
Base
Big Area
enough distance (D)
even brightness
touch or push
cover stop light
Small Area
too short distance (d)
spot-lite(s)
03A lens
02A Top cover
D
04A LED(s)
05A PCB
01A base
Fig. 8A
03B Lens
04B LED
05B PCB
d
02B Top cover
01B Base
Fig. 8B
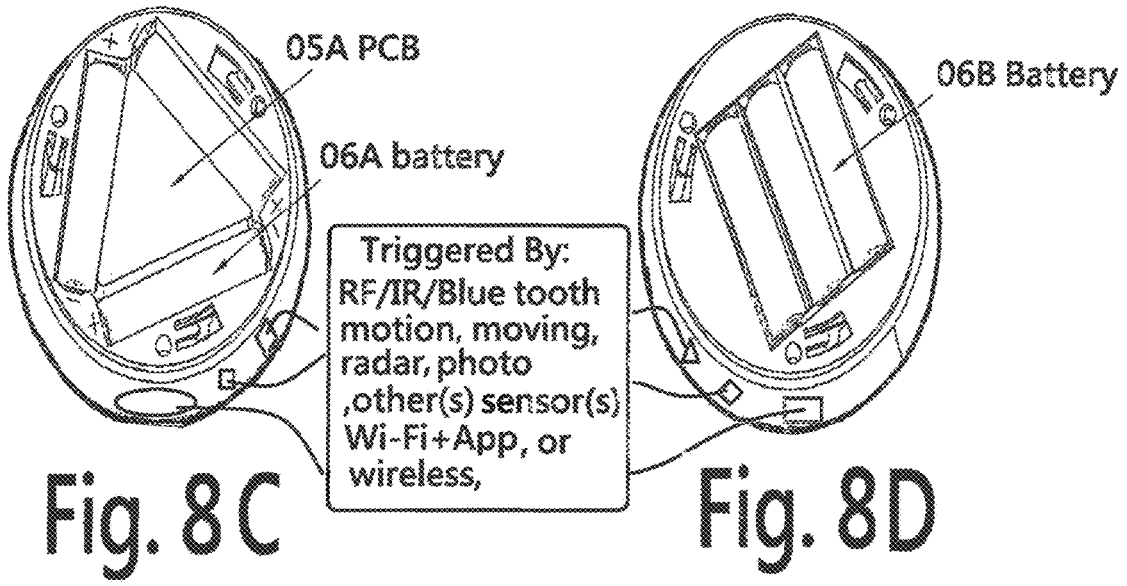
05A PCB
06A battery
Triggered By:
RF/IR/Blue tooth
motion, moving,
radar, photo
,other(s) sensor(s)
Wi-Fi+App, or
wireless,
06B Battery
Fig. 8C
Fig. 8D 9b
9d
9c
9a"
900
COB
9a'
9a
outlet unit
USB Ports
901

Figures 7, 8, 9:
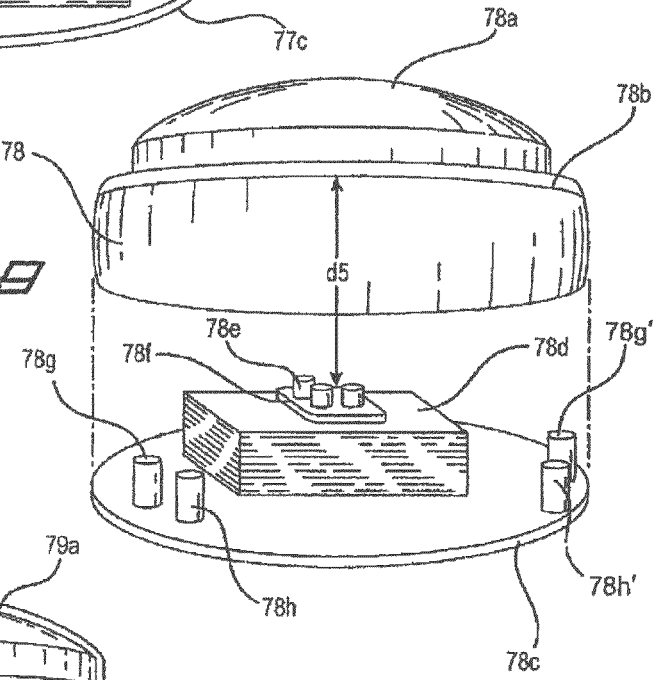
Figures 7, 8, 9, 10:
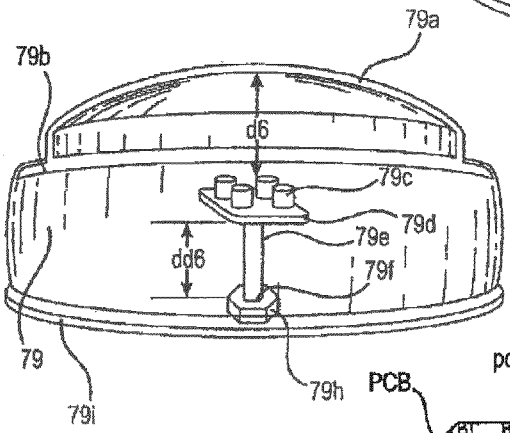

9a'
9e
Type A
9e'
Type C
9f
9g
9a"
9i
Light emit out lens (optic-medium)
9j
9k
9a 902
9a'
9a
9a"
Battery (PP1)
Changeable shape to desired geometric shape
9l
9m
903
9a'
9r
9a
9a"
9n
9p
9q
Light emit out lens (optic-medium)
COB LED light-source Fig. 10
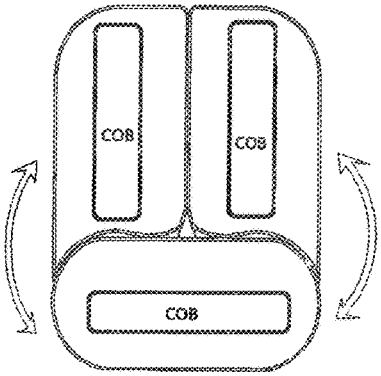
Fig. 10A
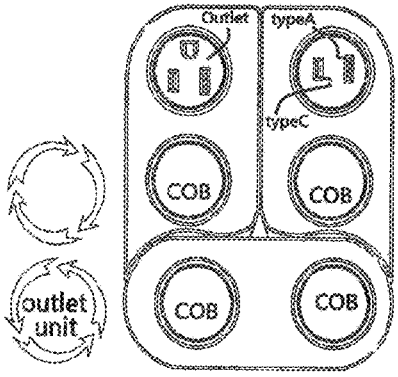
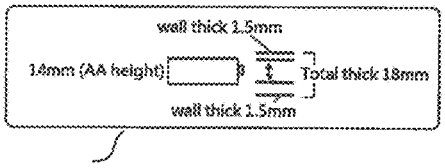
Changeable shape to desired geometric shape
Fig.10B
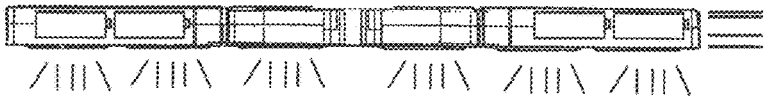
Fig.10C
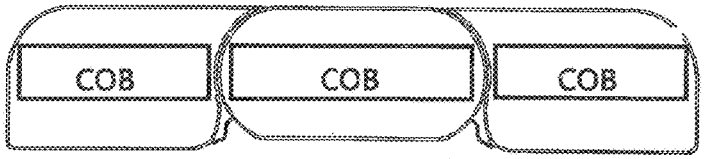
Fig.10D
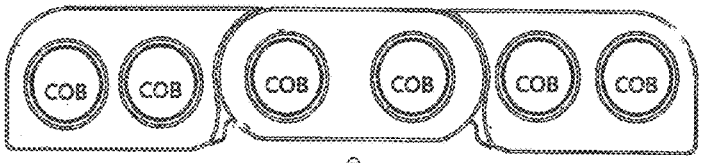
Fig.10 E
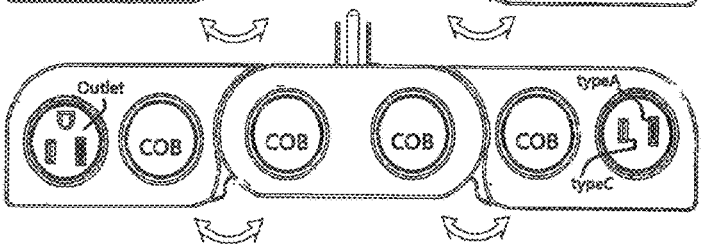
Fig.10F

Figures 7, 8, 9, 10, 11:
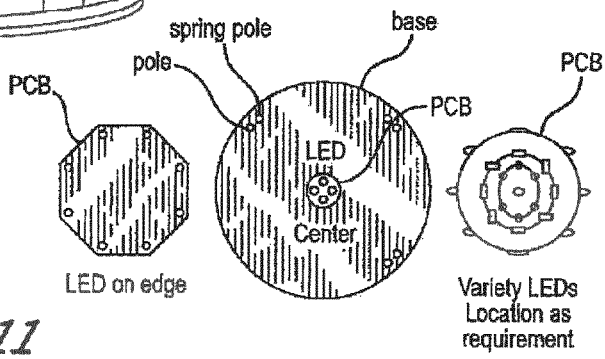

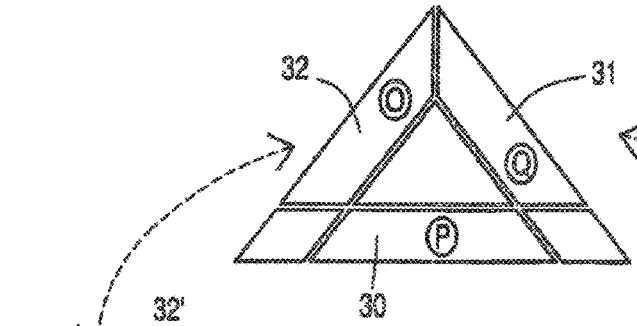
FIG. 11
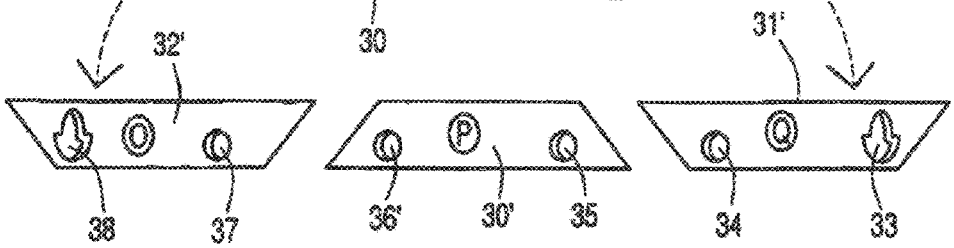
FIG. 12
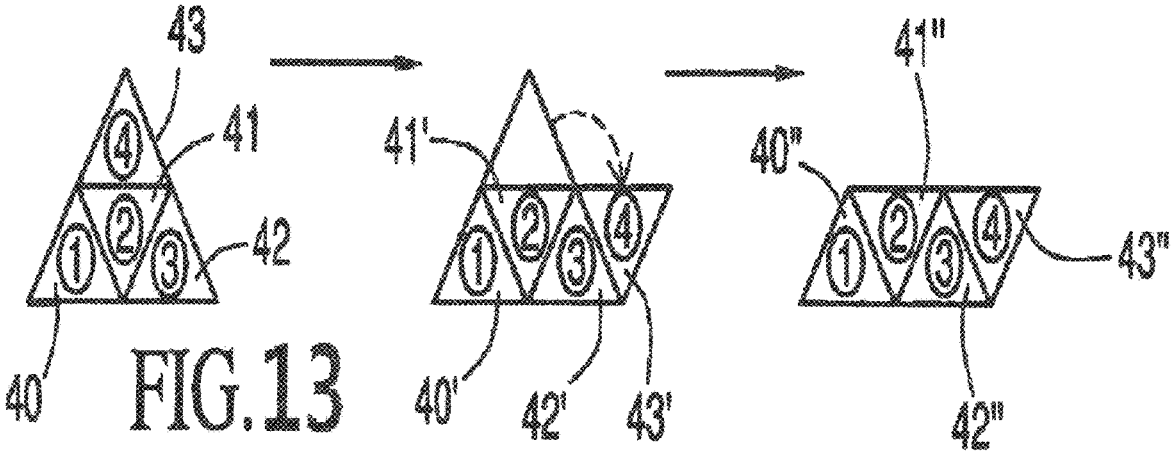
FIG. 13
FIG. 14-1 FIG. 14-2 FIG. 14-3 FIG. 14-4 FIG. 14-5
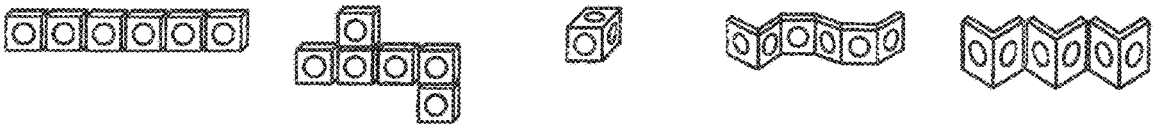

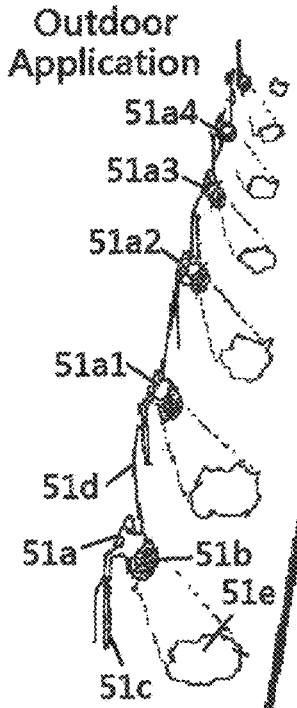
Fig. 15
Fig. 15A
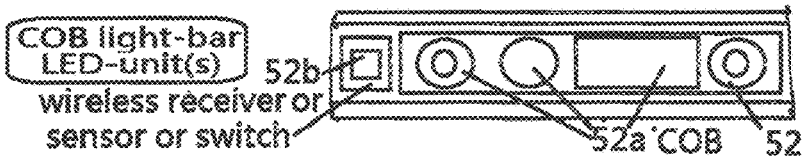
Fig. 15B
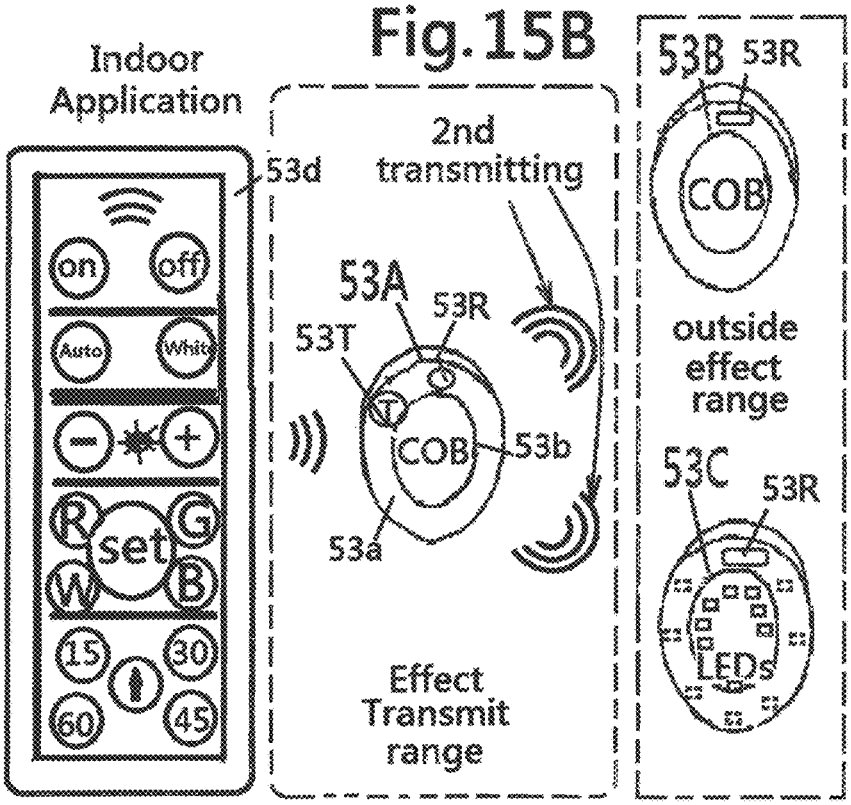
Fig. 15C
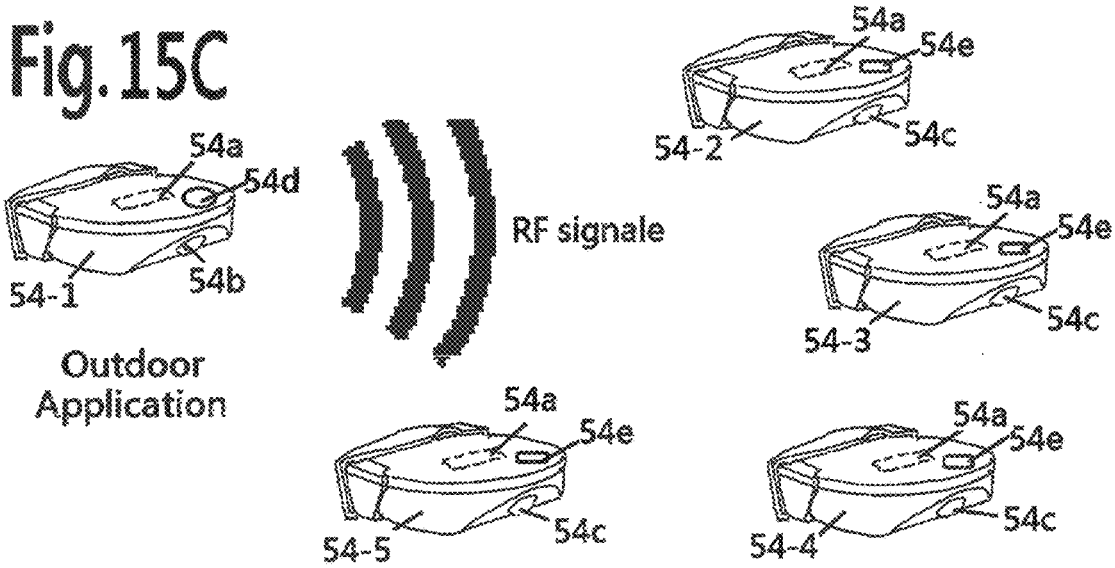

DC POWERED REMOTE CONTROL LED LIGHT-BAR ASSEMBLY

FILING HISTORY

The current invention is CIP of LED punk light, tap light, or light-bar assembly as below parent filed case(s). As current invention drawing FIGS. 9, 9A, 9B, 9C, 10, 10A, 10B, 10C, 10D, 10E, 11, 12, 13, 14-1 to 14-5.

(#UU-2) U.S. application Ser. No. 15/472,698 filed on Mar. 29, 2017, Pub. No. US 2017/0363 276 Pub. Date Dec. 21, 2017. This for punk light, tap light, ceiling light application, which is CIP of (#LLL-1) U.S. application Ser. No. 15/458,498 filed on Mar. 14, 2017 which is CIP of many parent filed case(s) and this parent filed case incorporated with magnetic reaction-force for detachable LED-unit(s) on the light-bar metal-track which is parent case(s) has magnetic reaction-force application.

(#UU-2010) U.S. application Ser. No. 12/938,628 filed on Nov. 2, 2010, U.S. Pub. No. US 2012/0106 202 publication date May 3, 2012. This is LED light-bar or transforming LED light-bar with built-in USB or outlets for additional features. which is CIP of (#RR-2010)(#57) U.S. application Ser. No. 12/887,700 filed on Sep. 22, 2010. Now is U.S. Pat. No. 8,083,392 issued on Dec. 27, 2011.

This application is CIP of co-pending parent filed case basing on co-pending (#UU-2) which is CIP of (UU-2010) which has the drawing FIGS. 9, 9A, 9B, 9C, 10, 10A, 10B, 10C, 10D, 10E, and As current invention drawing FIGS., 11, 12, 13, 14-1 to 14-5 for changing construction functions;

(#Z-08)(#50) U.S. Application Ser. No. 12/149,963 filed on May 12, 2008 which is CIP of (#Y-08)(#44) U.S. Application Ser. No. 12/073,095 filed on Feb. 29, 2008 which is CIP of (#X-08)(#81) U.S. Application Ser. No. 12/073,889 filed on Mar. 11, 2008 which is CIP of (#W-08)(#43) U.S. Application Ser. No. 12/007,076 filed on Jan. 7, 2008 which is CIP of (#V-08)(#42) U.S. Application Ser. No. 12/003,691 filed on Dec. 31, 2007 which is CIP of (#T-08)(#68) U.S. Application Ser. No. 12/894,865 filed on Sep. 30, 2010;

those parent filed case related the LED light-bar or LED Light-bar with built-in outlet or USB with (1) movable LED-unit(s), or (2) extendable or retractable LED-unit(s), or (3) transforming shape or construction LED light-unit of LED light-bar assemblies.

The current invention is CIP or Division for co-pending for touch top-lens to turn off LED(s) as current invention drawing FIGS. 7-8, 7-9, 7-10, 7-11 and FIGS. 8, 8A, 8B, 8C, 8D.

(#DD-1) U.S. application Ser. No. 12/834,435. This case is co-pending case, which is CIP of (#DD-2008) U.S. application Ser. No. 12/292,153 filed on Nov. 12, 2008 which is CIP of (#CC-1) U.S. application Ser. No. 12/907,443 filed on Oct. 19, 2010 which is CIP of (#CC-2008) U.S. application Ser. No. 12/232,505 filed on Sep. 18, 2008 now is U.S. Pat. No. 8,128,274;

for DC powered punk or tap light having LED(s) under top-lens and emit out image, patterns, light-beam through and touch/push the top-lens to turn-on or turn-off the LEDs illumination.

This also is CIP of the co-pending for all kind of LED light has DC or plug-in powered with COB LED light-source(s) and can change emit angle all drawing is same as FIGS. 1, 2, 3, 4, 5, 6.

(#TT-Division) U.S. application Ser. No. 15/995,423 filed on Jun. 1, 2018 which is CIP of co-pending (#TT-2) U.S. application Ser. No. 14/968,250, Filed on Dec. 14, 2015. which is Continue in Part of (#TT-1) U.S. application Ser. No. 14/944,953 Filed on Nov. 18, 2015. which is Continue in Part of (#TT-2010) U.S. application Ser. No. 12/866,832, Filed on Sep. 21, 2010.

This is Division filing for LED project light to project light beams to more than one areas.

(#QQ-10) U.S. application Ser. No. 12/771,003 Filed on Apr. 30, 2010 Public on Nov. 4, 2010, Public No. 2010/027-7089 for project at least one of LED light-beam, pattern, image.

The current invention for COB Light-light source and LED light source also is CIP of the co-pending (#JJ-3) U.S. application Ser. No. 14/9,790,747 Filed on Dec. 28, 2015

Which CIP of (#JJ-2) U.S. application Ser. No. 14/604,206 Filed on Jan. 23, 2015, now U.S. Pat. No. 9,163,799

Which is CIP of (#JJ-1) U.S. application Ser. No. 13/534,281 Filed on Jun. 27, 2012, now U.S. Pat. No. 8,960,988 claim 1 for power saving features.

Which is CIP of (#JJ-2010) U.S. application Ser. No. 12/710,561 Filed on Feb. 23, 2010, now U.S. Pat. No. 8,303,158

Which is Division of (#OO-2010) U.S. application Ser. No. 12/711,456 Filed on Feb. 24, 2010, now is U.S. Pat. No. 8,083,376. Claim 14 for power saving and claim 15 for cost saving features.

Which for apply the eye's persistence of vision theory to make a quickly flashing which people eyes See continue turn-on but it actually having predetermined percentage is turn-off of each cycles, So can save a lot of power for power saving functions. Also, the co-pending parent filed case also Teach cost saving to incorporate with boost-voltage circuit to raise the lower voltage of total rechargeable or non-rechargeable batteries to sufficient higher voltage to trigger the said at least one of LED light-source(s).

This also is CIP of the co-pending for LED light has built-in wireless remote control by IR, RF and preferred blue-tooth, Wi-Fi with download APP . . . etc. As current invention drawing FIGS. 15, 15A, 15B, 15C.

(#11-4) U.S. application Ser. No. 16/032,664 filed on Jul. 11, 2018. This has all kind of sensor and wireless controller including radar detector and linkable from RF remote controller emit $1^{st}$ transmitted-signals to LED-unit(s) and LED-unit received and make $2^{nd}$ transmitting signal to those LED-unit(s) away from $1^{st}$ remote-controller effect transmitting range as FIGS. 15, 15A, 15B, 15C shown. Which is CIP of (#VVV-1) U.S. application Ser. No. 14/817,675 Filed on Aug. 4, 2015 Public on Nov. 26, 2015 Public No. 2015/034/0826. This is CIP of Application No.

(#VVV-2013) U.S. application Ser. No. 13/910,295 filed on Jun. 5, 3023 now is U.S. Pat. No. 9,732,921 issued on Aug. 15, 2017. The Co-inventor Co-pending case is for wall cover LED light has built-in USB or Wi-Fi, camera, APP or outlets which only has the main LED-unit without side/top/ bottom light. Also, The Pending case has no any COB LEDs which has a lot of features to make simple and easily for LED light-beam.

This application is a continuation of multiple Function LED light having radar detector and wireless remote-controller with desired area or indicator light function(s). As current invention drawing FIGS. 9, 9A. 9B.

(#R-5) U.S. application Ser. No. 16/285,631 filed Feb. 26, 2019, which is CIP of (#R-4) U.S. application Ser. No. 16/242,761, filed Jan. 8, 2019, which is CIP of (#R-3) U.S. application Ser. No. 14/739,499, filed Jun. 15, 2015, which is CIP of (#R-2) U.S. application Ser. No. 14/739,666, filed Jun. 15, 2015, which is CIP of (#R-1) U.S. application Ser. No. 14/739,397, filed Jun. 15, 2015, now is U.S. Pat. No. 10,184,624 issued on Jan. 22, 2019. which is CIP of (#R-07)(Still pending for over 12 years) U.S. application Ser. No. 11/806,285, filed May 31, 2007, which is CIP of U.S. patent application Ser. No. 10/883,747 filed on Jul. 6, 2004. which is CIP of (#Q-07) now U.S. Pat. No. 7,632,004 LED night light with more than one optic means U.S. patent application Ser. No. 11/806,284, filed May 31, 2007, now is U.S. Pat. No. 7,632,004 issued on Dec. 15, 2009. which is CIP of (#K-06) LED night light has area-illumination by multiple time reflection and refraction 20

U.S. application Ser. No. 11/498,874 filed on Aug. 4, 2006 (Still pending). which is CIP of U.S. application Ser. No. 10/954,189 filed on Oct. 1, 2004. which is CIP of (M-06) U.S. Pat. No. 7,611,253 multiple functions LED night light with air freshener U.S. patent application Ser. No. 11/527,628, filed Sep. 27, 2006, now is U.S. Pat. No. 7,611,253 issue on Nov. 3, 2009, which is CIP of (#L) now U.S. Pat. No. 8,545,090 LED night light with changeable display unit U.S. patent application Ser. No. 11/527,629, filed Sep. 27, 2006, now is U.S. Pat. No. 8,545,090 issue on Oct. 1, 2013, which is CIP of (#J5) now is U.S. Pat. No. 8,811,122 LED night light with time piece U.S. application Ser. No. 13/428,086, filed Mar. 23, 2012, now is U.S. Pat. No. 8,811,122 issue on Aug. 19, 2014, which is CIP of (#J-4)(#63) now is U.S. Pat. No. 8,289,814 LED night light with time piece U.S. application Ser. No. 12/894,782, filed Sep. 30, 2010, now is U.S. Pat. No. 8,289,814 issue on Oct. 16, 2012, which is CIP of (#J-3) now is U.S. Pat. No. 8,164,984 LED night light with time piece U.S. application Ser. No. 12/545,922, filed Aug. 24, 2009, now is U.S. Pat. No. 8,164,984 issue on Apr. 24, 2012, which is CIP of (#I-06)(#35) U.S. Pat. No. 7,568,829 poly night light U.S. application Ser. No. 11/498,881, filed Aug. 4, 2006, now is U.S. Pat. No. 7,568,829 issue on Aug. 4, 2009, which is CIP of (#H-1)(#54) U.S. Pat. No. 8,029,182 multiple light source night light U.S. application Ser. No. 12/546,012, filed Aug. 24, 2009, now is U.S. Pat. No. 8,029,182 issue on Oct. 4, 201, which is CIP of (#H-05)(#34) U.S. Pat. No. 7,455,444 Multiple light source Night light U.S. application Ser. No. 11/255,981, filed Oct. 24, 2005, now is U.S. Pat. No. 7,455,444 issued on Nov. 25, 2008, This is This application is continuation of U.S. application Ser. No. 10/883,747 filed on Jul. 6, 2004.

This application is a continuation of (#Q-07) now U.S. Pat. No. 7,632,004

LED night light with more than one optic means

U.S. application Ser. No. 11/806,284, filed May 31, 2007, now is U.S. Pat. No. 7,632,004 issued on Dec. 15, 2009

This application is a continuation of (#K-06)

LED night light has area-illumination by multiple time reflection and refraction 20

U.S. application Ser. No. 11/498,874 filed on Aug. 4, 2006 (Still pending)

This application is a continuation of

U.S. application Ser. No. 10/954,189 filed on Oct. 1, 2004.

This application is a continuation of (M-06) U.S. Pat. No. 7,611,253 multiple functions LED night light with air freshener

U.S. application Ser. No. 11/527,628, filed Aug. 27, 2006, now is U.S. Pat. No. 7,611,253 issue on Nov. 3, 2009, This application is a continuation of (#L) now U.S. Pat. No. 8,545,090

LED night light with changeable display unit

U.S. patent application Ser. No. 11/527,629, filed Sep. 27, 2006, now is U.S. Pat. No. 8,545,090 issue on Oct. 1, 2013, This application is a continuation of (#J-6) now is U.S. Pat. No. 9,128,692 LED night light with time piece U.S. patent application Ser. No. 14/252,102, filed Apr. 14, 2014, now is U.S. Pat. No. 9,128,692 issue on Sep. 8, 2015, This application is a continuation of (#J-5) now is U.S. Pat. No. 8,811,122 LED night light with time piece U.S. patent application Ser. No. 13/428,086, filed Mar. 23, 2012, now is U.S. Pat. No. 8,811,122 issue on Aug. 19, 2014, This application is a continuation of (#J-4) now is U.S. Pat. No. 8,289,814 LED night light with time piece U.S. patent application Ser. No. 12/894,782, filed Sep. 30, 2010, now is U.S. Pat. No. 8,289,814 issue on Oct. 16, 2012, This application is a continuation of (#J-3) now is U.S. Pat. No. 8,164,984 LED night light with time piece U.S. patent application Ser. No. 12/545,922, filed Aug. 24, 2009, now is U.S. Pat. No. 8,164,984 issue on Apr. 24, 2012, This application is a continuation of (I-06) U.S. Pat. No. 7,568,829 poly night light U.S. patent application Ser. No. 11/498,881, filed Aug. 4, 2006, now is U.S. Pat. No. 7,568,829 issue on Aug. 4, 2009, This application is a continuation of (#H-1) U.S. Pat. No. 8,029,182 multiple light source night light

U.S. patent application Ser. No. 12/546,012, filed Aug. 24, 2009, now is U.S. Pat. No. 8,029,182 issue on Oct. 4, 201, which is a continuation of (#H-05) U.S. Pat. No. 7,455,444

Multiple light source Night light

U.S. patent application Ser. No. 11/255,981, filed Oct. 24, 2005, now is U.S. Pat. No. 7,455,444 issued on Nov. 25, 2008

BACKGROUND

This is Division for co-inventor plurality of parent filed case.

The current LED light for night time applications at market only offer one area or location for near-by illumination purpose. Those are non-angle adjustable or has complicated angle adjustment mechanical construction for expensive labors work. Or, use plurality of LEDs under the clear top-lens to form the very un-comfortable directly LED light emit through the clear top-lens for spot-light(s) and non-even brightness light effects. Or, simple push on and push off the illumination. So, the current invention makes big improvement to make perfect light device for people to use. and All market application different with current invention features such as (1) light trigger by at least one of a. motion, PIR, Photo, moving, radar sensor or detectors, (2) light trigger by at least one of IR, RF, blue-tooth, ZigBee, Z-way, Wi-Fi with download APP software, (3) light has holder or tray to install on surface by at least one of installation-kits select from tape, Velcro-tape, magnetic-piece, other traditional skill kit, (4) light install on or assemble with base or tray by reaction-force of built-in tray or holder magnetic-piece(s) and the conductive-parts of batteries loaded-into LED-light or light-bar.

(5) Light trigger by wired or wireless trigger-system to turn-on and turn-off system as pre-determined the function(s), color(s), color-changing(s), color-selection(s), brightness, or functions selection(s) including (5-1) sensor distance(s), or (5-2) sensor angle(s), or (5-3) sensor or dust-to-dawn, or (5-4) hi-low-medium-any desired brightness, or (5-5)

(6) angle adjustment by simple magnetic reaction force or traditional skill with mechanical or Automatically by motor with or without wireless controlling system.

The current invention apply the Dip or Dice or Chip LEDs or COB (Chip On Board) LEDs to emit light beam through LED light more than one of opening(s), lens, windows (Not punch through like openings) to near-by areas not same as co-inventor co-pending LED light to project remote-area(s) such as above discussed (#DD-1)(DD-2008)(#CC-1)(#CC-2008) the said at least one of beam or patterns or images project to remote distanced locations by one convex or project optics-lens. Even, the co-inventor co-pending (#QQ-2010)(#TT-2010)(#TT-1=DD-CIP)(#TT-2) teach LED light has both project remote-area(s) and near-by area(s) illumination but current invention is CIP or Division for above discussed features (1) to (6) which make all co-pending parent filed case become more practically application product(s).

The current invention is 1st one to apply the COB LED(s) for plug-in outlet night light as co-pending (#TT-Division) as above listed U.S. application Ser. No. 15/995,423 filed on Jun. 1, 2018, and the current invention also is 1st one to apply COB LED(s) for DC powered LED light with unique above discussed features (1) to (6). Those features (1) to (6) totally solve the dip or dice or chip LEDs bright spot-points for short distance to lens and also solve the dip or dice or chip LEDs big labor for soldering each small PCB to main PCB while the LED light need to have multiple direction light-beam emitting. One of preferred LED light source is the COB is so simple to solve the brighter-sports problem, and also more simple or easy to use more than one piece COB to face desired multiple of directions than traditional skill to solder tiny plurality of chip or dice to assembly to small PCB(s) and make electric connections for many child-board with center circuit or PCB. Also, the COB has more advanced technical for have (1) more than one color(s), and (2) bendable to desire angle, and (3) can make any shape with desired brightness and colors, and (4) work with IC chip to make desired color-changing, color-selection, function(s) selection as above discussed Features (1) to (6).

The current invention is the 1st one of the night time use LED light for all purpose including under-cabinet, desktop, laundry room, garage, patio (while has solar powered) or plug-into outlets night light to use LED light has more than one of the opening(s) (Punch through), lens, windows (not punch through like openings) emit out the light-beam to illuminate the near-by more than one locations. Also, the more than one areas to emit out the LED light also is co-pending filed case (#R-6)(#R-5)(#R-4)(#R-3)(#R-2)(#R-2007) which is CIP of (#H-05)(#G-07) as above listed co-pending filed case(s).

The current invention is the 1st one has the different housing or parts has angle adjustable to emit one or at least one LED light-beam to outside the LED light.

The current invention offers one LED light cost but offer for one while use one LED-unit or more than one while use more than one LED-unit(s) locations has near-by illumination with or without (*a*) angle adjustable features or-and (*b*) other preferred add-on one or more than one of functions select from (1) Motions sensor or others sensor function, (2) photo sensor, (3) Switch on/off, (4) wireless control function by Wi-Fi, APP, Z-way, Zig-Bee, infra-red, RF circuitry, (5) power fail or emergency or evacuation light functions, (6) color changing, color freeze function, (7) changing functions between more than one of functions such as party light, illumination light, chasing light, fade-in or fade-out light, hi-low brightness, color-selection, illumination or strong-strobe light, motion or non-motion, or other different functions to change by operated switch, remote controller, pre-setting IC.

BRIEF DRAWING

Figure 2:
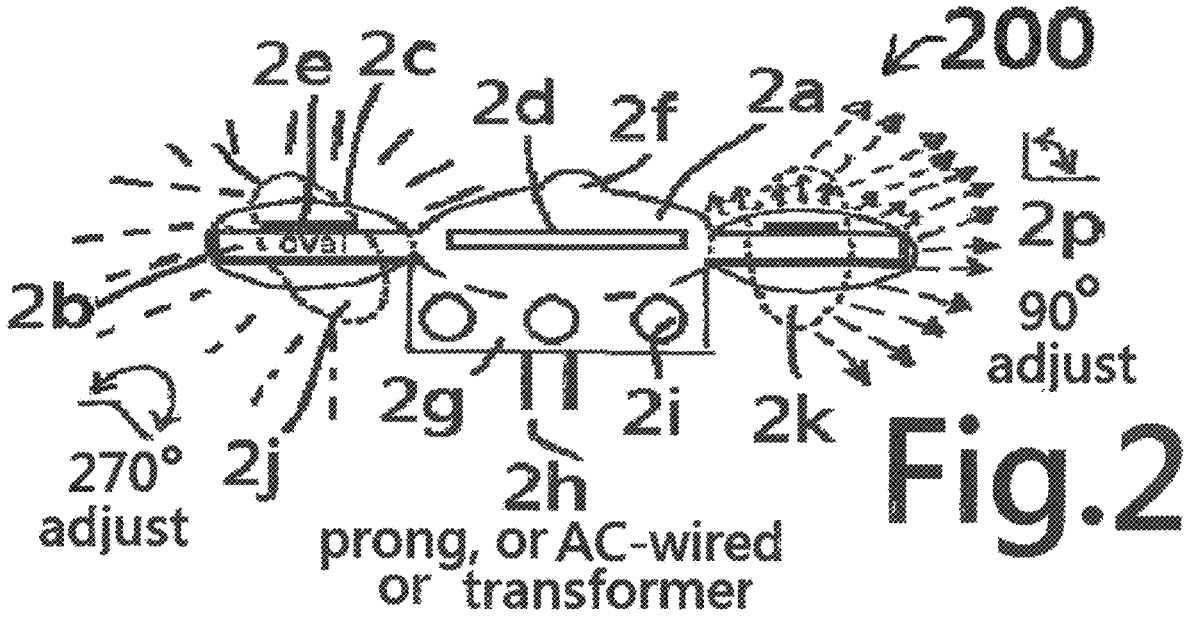
Figure 4:
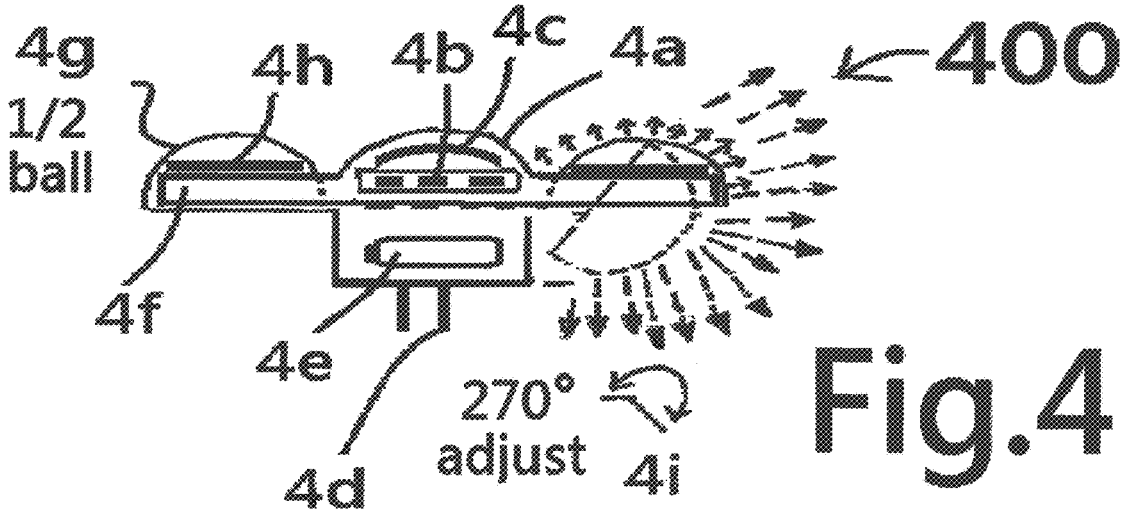

1. FIG. 1 is 1st one of prefer embodiment(s) for current invention,

2. FIGS. 2, 3, 4 is one of prefer embodiment(s) detail construction for oval-unit for 90 degree tilt to offer lighted light beam or patterns or image for more than one area(s) for illumination.

Figure 5:
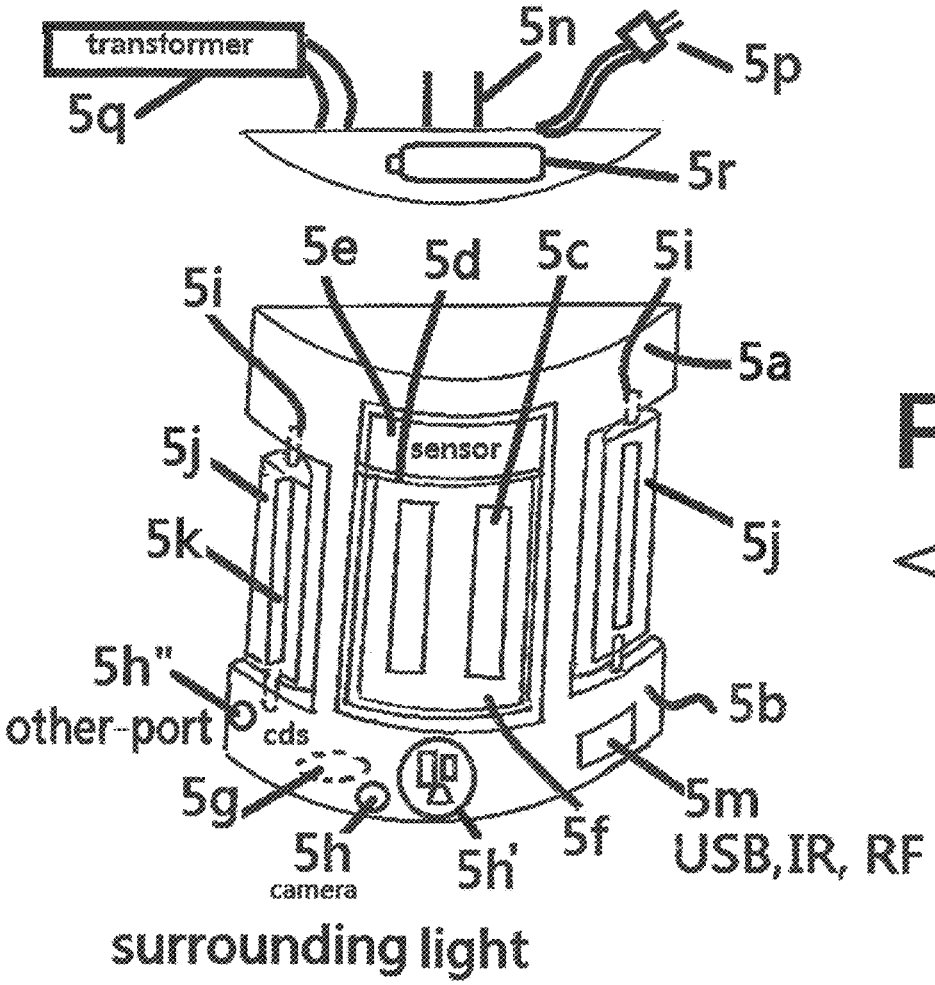
Figure 6:
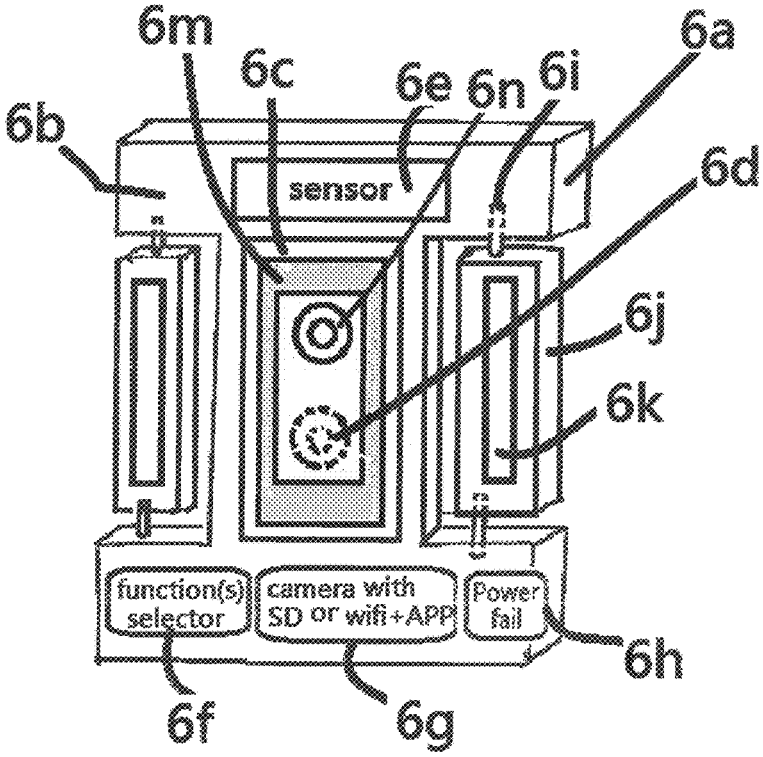

3. FIGS. 5, 6 disclosure 2 of prefer embodiment(s) of many other embodiment has alternative or equal functions or replaceable embodiments with desired functions.

4. FIGS. 7, 7A, 7B, 7C show the one of preferred embodiment(s) for angle adjustment with preferred wider or medium or small lens to meet market requirement.

5. FIGS. 7D, 7E show one of preferred embodiment for current invention with base and one of LED-unit out of N-unit(s) to form an IR or RF or wireless control systems and adjustable height with locking-kits.

6. FIGS. 7-8, 7-9, 7-10, 7-11 show the co-pending (#DD-1) parent filed DC powered LED light has top-lens whenever the top-lens be touched or pushed will stop any light-function(s) operating instantly priority than per-program setting.

7. FIGS. 8, 8A, 8B, 8C, 8D show the co-pending (#UU-2) parent filed DC powered LED light has opaque or whiten top-lens and LEDs located on far-enough distance (D) to make even brightness emit out from top-lens as FIG. 8A; the said LED light is triggered by preferred one of triggered-system as FIGS. 8C, 8D. With or without top-lens or top-cover is a 1st priority switch to turn off the LED(s) at any time while been touched or pushed.

8. FIGS. 9, 9A, 9B, 9C and FIGS. 10, 10A, 10B, 10C, 10D, 10E, 10F and FIGS. 11, 12, 13, 14-1 to 14-5 show some preferred transforming construction of LED light-bar assemblies have at least one of built-in (i) plurality LEDs with optic-medium, or (ii) simple COB light-source, or (iii) USB-port(s), or (iv) Outlets with IC or battery or other power-arrangement(s) selections for indoor or outdoor applications.

9. FIGS. 15, 15A, 15B, 15C show some preferred embodiments have built-in wireless control-systems select from IR, RF, Sensor, motion/photo/radar/moving sensor or sensors, blue-tooth, Z-way, Zig-Bee, Wi-Fi, Wi-Fi extender, App download software, 3/4/5/6 G, internet, or other wireless plate-forms to make the preferred LED light-bar assembly or LED light assembly or LED lighting assembly to make preferred light functions.

Figure 16:
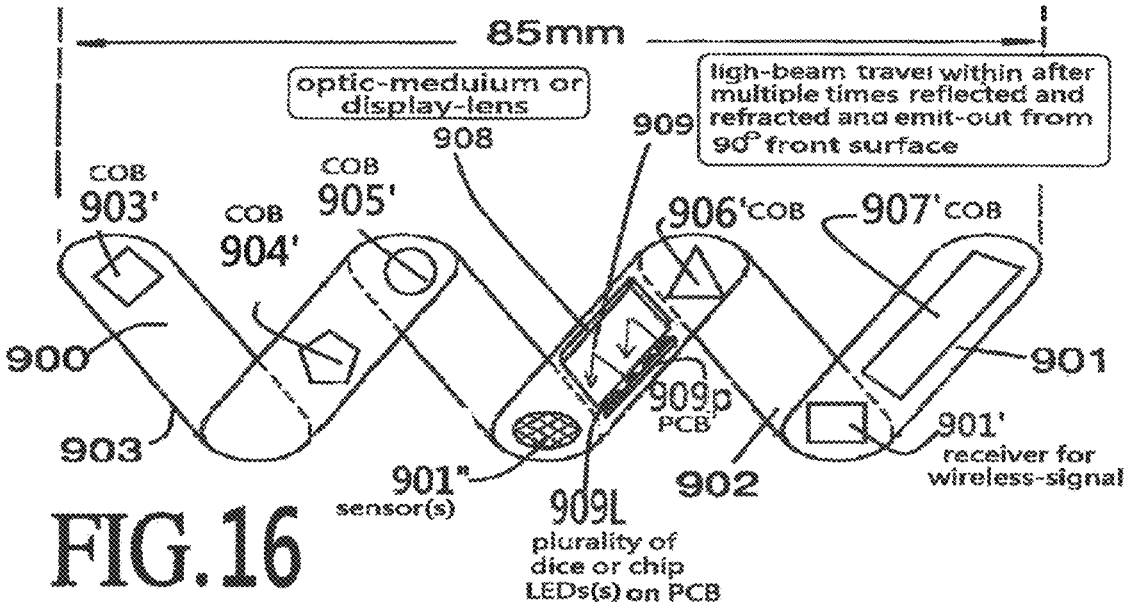

10. FIG. 16 show the one of co-pending filed case with extendable LED light-bar assembly which has built-in plurality of LED with optic-medium to make multiple time reflection and refraction within the optic-medium which also is top-lens and after multiple reflection and refraction (909) eliminated all strong spot-light(s) and create a very even brightness area or surface light-beam emit out from optic-medium (908). Or, the light-bar or LED-unit (901)(902)(903) has built-in simple installation and less labor LED COB-piece(s) which may in different shape, color(s), size and brightness as (903')(904")(905')(906')(907'). The said LED-unit(s) or light-bar (901)(902)(903) also can have built-in different sensor(s) (901") or trigger-system(s) or wireless receiving or transmitting kits (901') to make wireless triggered by sensor(s) or trigger-systems select as above discussed at least one of IR, RF, Blue-tooth, Z-way, Zig-Bee, Wi-Fi with download APP go through 3/4/5/6G systems or internet or cloud or storage-device or server(s) to make remote controlling or remote triggering functions or selection or setting or adjustment . . . etc.

Figure 16A:
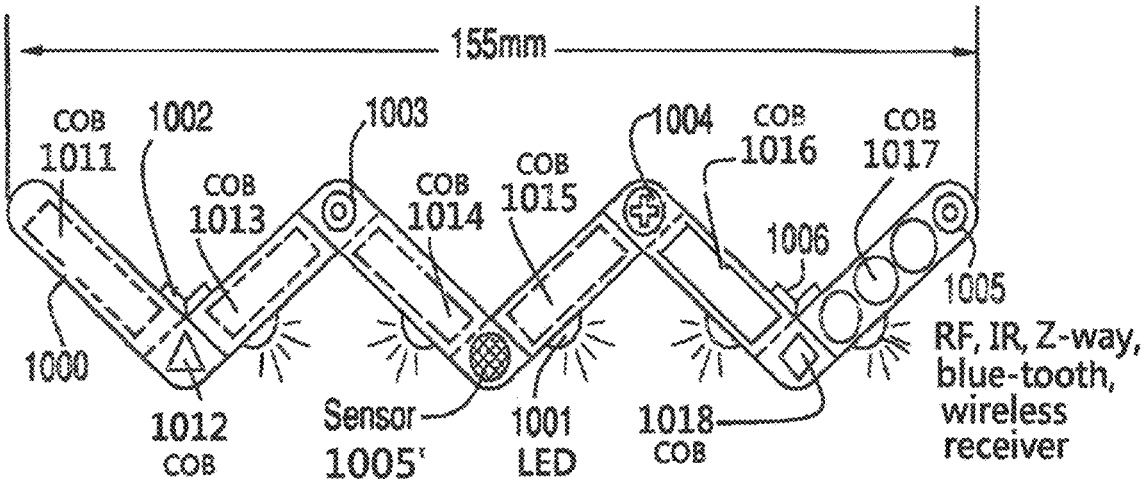

11. FIG. 16A show the alternative arrangement for extendable and retractable or transformable LED light-bar assembly which can change length for narrow WW shape to wide opening or even to full straight-shape to become much longer length to offer the much longer areas for illumination such as from FIG. 16 85 cm to FIG. 16A 155 cm, so this is one of the features for current invention for extendable or retractable or transforming to change the each LED-unit(s) or light-bar(s) LED light-source related position, orientation. From FIG. 16A can see the many light bars (1000) and each one have desired plurality of LED with optic-medium or simple geometric-shape of CON as light-source(s) such as rectangular-shape (1011)(1013)(1015) (1016) so while WWW shape to change to full-straight shape it will be like a long light-bar and each rectangular-shape COB(s) offer a pre-determined lighted-area. The said LED light-bar assembly also has built-in sensor(s) (1005') or wireless trigger-system (1005)

DETAILS DESCRIPTION

The current invention is CIP of LED punk light, tap light, or light-bar assembly as below parent filed case(s). As current invention drawing FIGS. 9, 9A, 9B, 9C, 10, 10A, 10B, 10C, 10D, 10E, 11, 12, 13, 14-1 to 14-5.

(#UU-2) U.S. application Ser. No. 15/472,698 filed on Mar. 29, 2017, Pub. No. US 2017/0363 276 Pub. Date Dec. 21, 2017. This for punk light, tap light, ceiling light application, which is CIP of (#UU-2010) U.S. application Ser. No. 12/938,628 filed on Nov. 2, 2010, U.S. Pub. No. US 2012/0106 202 publication date May 3, 2012. This is LED light-bar or transforming LED light-bar with built-in USB or outlets for additional features. which is CIP of (#RR-2010)(#57) U.S. application Ser. No. 12/887,700 filed on Sep. 22, 2010. Now is U.S. Pat. No. 8,083,392 issued on Dec. 27, 2011.

This application is CIP of co-pending parent filed case basing on co-pending (#UU-2) which is CIP of (UU-2010) which has the drawing FIGS. 9, 9A, 9B, 9C, 10, 10A, 10B, 10C, 10D, 10E, and As current invention drawing FIGS. 11, 12, 13, 14-1 to 14-5 for changing construction functions;

(#Z-08)(#50) U.S. application Ser. No. 12/149,963 filed on May 12, 2008 which is CIP of (#Y-08)(#44) U.S. application Ser. No. 12/073,095 filed on Feb. 29, 2008 which is CIP of (#X-08)(#81) U.S. application Ser. No. 12/073,889 filed on Mar. 11, 2008 which is CIP of (#W-08)(#43) U.S. application Ser. No. 12/007,076 filed on Jan. 7, 2008 which is CIP of (#V-08)(#42) U.S. application Ser. No. 12/003,691 filed on Dec. 31, 2007 which is CIP of (#T-08)(#68) U.S. application Ser. No. 12/894,865 filed on Sep. 30, 2010;

those parent filed case related the LED light-bar or LED Light-bar with built-in outlet or USB with (1) movable LED-unit(s), or (2) extendable or retractable LED-unit(s), or (3) transforming shape or construction LED light-unit of LED light-bar assemblies.

The current invention is CIP or Division for co-pending for touch top-lens to turn off LED(s) as current invention drawing FIGS. 7-8, 7-9, 7-10, 7-11 and FIGS. 8, 8A, 8B, 8C, 8D.

(#DD-1) U.S. application Ser. No. 12/834,435. This case is co-pending case, which is CIP of (#DD-2008) U.S. application Ser. No. 12/292,153 filed on Nov. 12, 2008 which is CIP of (#CC-1) U.S. application Ser. No. 12/907,443 filed on Oct. 19, 2010 which is CIP of (#CC-2008) U.S. application Ser. No. 12/232,505 filed on Sep. 18, 2008 now is U.S. Pat. No. 8,128,274;

for DC powered punk or tap light having LED(s) under top-lens and emit out image, patterns, light-beam through and touch/push the top-lens to turn-on or turn-off the LEDs illumination.

This also is CIP of the co-pending for all kind of LED light has DC or plug-in powered with COB LED light-source(s) and can change emit angle all drawing is same as FIGS. 1,2,3,4,5,6.

(#TT-Division) U.S. application Ser. No. 15/995,423 filed on Jun. 1, 2018 which is CIP of co-pending (#TT-2) U.S. application Ser. No. 14/968,250, Filed on Dec. 14, 2015. which is Continue in Part of (#TT-1) U.S. application Ser. No. 14/944,953 Filed on Nov. 18, 2015. which is Continue in Part of (#TT-2010) U.S. application Ser. No. 12/866,832, Filed on Sep. 21, 2010.

This is Division filing for LED project light to project light beams to more than one areas.

(#QQ-10) U.S. application Ser. No. 12/771,003 Filed on Apr. 30, 2010 Public on Nov. 4, 2010, Public No. 2010/027-7089 for project at least one of LED light-beam, pattern, image.

This also is CIP of the co-pending for LED light has built-in wireless remote control by IR, RF and preferred blue-tooth, Wi-Fi with download APP . . . etc. As current invention drawing FIGS. 15, 15A, 15B, 15C.

(#11-4) U.S. application Ser. No. 16/032,664 filed on Jul. 11, 2018. This has all kind of sensor and wireless controller including radar detector and linkable from RF remote controller emit $1^{st}$ transmitted-signals to LED-unit(s) and LED-unit received and make $2^{nd}$ transmitting signal to those LED-unit(s) away from $1^{st}$ remote-controller effect transmitting range as FIGS. 15, 15A, 15B, 15C shown. Which is CIP of (#VVV-1) U.S. application Ser. No. 14/817,675 Filed on Aug. 4, 2015 Public on Nov. 26, 2015 Public No. 2015/034/0826. This is CIP of Application No.

(#VVV-2013) U.S. application Ser. No. 13/910,295 filed on Jun. 5, 3023 now is U.S. Pat. No. 9,732,921 issued on Aug. 15, 2017. The Co-inventor Co-pending case is for wall cover LED light has built-in USB or Wi-Fi, camera, APP or outlets which only has the main LED-unit without side/top/bottom light. Also, The Pending case has no any COB LEDs which has a lot of features to make simple and easily for LED light-beam.

This application is a continuation of multiple Function LED light having radar detector and wireless remote-controller with desired area or indicator light function(s). As current invention drawing FIGS. 9, 9A. 9B.

(#R-5) U.S. application Ser. No. 16/285,631 filed Feb. 26, 2019, which is CIP of (#R-4) U.S. application Ser. No. 16/242,761, filed Jan. 8, 2019, which is CIP of (#R-3) U.S. application Ser. No. 14/739,499, filed Jun. 15, 2015, which is CIP of (#R-2) U.S. application Ser. No. 14/739,666, filed Jun. 15, 2015, which is CIP of (#R-1) U.S. application Ser. No. 14/739,397, filed Jun. 15, 2015, now is U.S. Pat. No. 10,184,624 issued on Jan. 22, 2019. which is CIP of (#R-07)(Still pending for over 12 years) U.S. application Ser. No. 11/806,285, filed May 31, 2007, which is CIP of U.S. patent application Ser. No. 10/883,747 filed on Jul. 6, 2004. which is CIP of (#Q-07) now U.S. Pat. No. 7,632,004 LED night light with more than one optic means U.S. patent application Ser. No. 11/806,284, filed May 31,2007, now is U.S. Pat. No. 7,632,004 issued on Dec. 15, 2009. which is CIP of (#K-06) LED night light has area-illumination by multiple time reflection and refraction 20

U.S. application Ser. No. 11/498,874 filed on Aug. 4, 2006 (Still pending). which is CIP of U.S. application Ser. No. 10/954,189 filed on Oct. 1,2004. which is CIP of (M-06) U.S. Pat. No. 7,611,253 multiple functions LED night light with air freshener U.S. patent application Ser. No. 11/527,628, filed Sep. 27, 2006, now is U.S. Pat. No. 7,611,253 issue on Nov. 3, 2009, which is CIP of (#L) now U.S. Pat. No. 8,545,090 LED night light with changeable display unit U.S. patent application Ser. No. 11/527,629, filed Sep. 27, 2006, now is U.S. Pat. No. 8,545,090 issue on Oct. 1, 2013, which is CIP of (#J5) now is U.S. Pat. No. 8,811,122 LED night light with time piece U.S. application Ser. No. 13/428,086, filed Mar. 23, 2012, now is U.S. Pat. No. 8,811,122 issue on Aug. 19, 2014, which is CIP of (#J-4)(#63) now is U.S. Pat. No. 8,289,814 LED night light with time piece U.S. application Ser. No. 12/894,782, filed Sep. 30, 2010, now is U.S. Pat. No. 8,289,814 issue on Oct. 16, 2012, which is CIP of (#J-3) now is U.S. Pat. No. 8,164,984 LED night light with time piece U.S. application Ser. No. 12/545,922, filed Aug. 24, 2009, now is U.S. Pat. No. 8,164,984 issue on Apr. 24, 2012, which is CIP of (#1-06)(#35) U.S. Pat. No. 7,568,829 poly night light U.S. application Ser. No. 11/498,881, filed Aug. 4, 2006, now is U.S. Pat. No. 7,568,829 issue on Aug. 4, 2009, which is CIP of (#H-1)(#54) U.S. Pat. No. 8,029,182 multiple light source night light U.S. application Ser. No. 12/546,012, filed Aug. 24, 2009, now is U.S. Pat. No. 8,029,182 issue on Oct. 4, 201, which is CIP of (#H-05)(#34) U.S. Pat. No. 7,455,444 Multiple light source Night light U.S. application Ser. No. 11/255,981, filed Oct. 24, 2005, now is U.S. Pat. No. 7,455,444 issued on Nov. 25, 2008, This is The current invention has at least one preferred of following feature:

a. The current invention can apply traditional Dip or Chip LED which has the bright spots issues and aim plurality of LED(s) light-beam to light-transmitting-medium or diffusor-lens or reflective-lens or refractive-lens or refractor-lens to get even brightness or multiple directions LED light-beam. The COB LED has much better solve the bright spots issues by apply the preferred optics-lens especially for short distance application as FIG. 1A and FIG. 7E, FIG. 8A.

b. The current invention can apply traditional Dip or Dice or Dip LED for soldering plurality of LED(s) on small PCB, COB is easily to make any width or length and geometric shape so prevent from soldering plurality or number of chips, dice, dip LEDs so many soldering works. This is big issued for manufacturing cost for labor to assembly individual LED-on board to solder or assembly to main-PCB.

c. The current Night time use LED light has more than one of areas, sections, openings, windows (not punch through called windows, not opening which is punch through) and COB or Chips LED or Dip LEDs inside to emit light out.

d. The current Night time use LED light has simple magnetic reaction angle adjustment features to light any areas by the said LED light having one or more of the said main-housing light, or side lights, or top light, or bottom light install on the said LED light which only little cost increase but for consumer buy one light get multiple location illumination is very good to consumer.

e. The current night time use LED light has simple magnetic reaction angle adjustment features to offer more than one of locations for illumination and main light, or side or top or bottom lights is angle adjustable to offer near-by areas, location, space be illuminated. Not same as co-inventors co-pending filed case to project LED light beams, patterns, image to remote and distanced locations.

f. The current night time use LED light has circuitry or-and controller to make the COB, or Dice, or Chip or Dip LED(s) has at least one or more combinations of desired functions including (e-1) color changing function: from one color to other colors, auto changing, select color, (e-2) change functions: from motion-sensor to non-motion sensor, or high-brightness to low-brightness, or (e-3) dimmable or adjustable light brightness function, (e-4) Power fail or emergency or evacuation light with or without flashlight functions (e-5) motion sensor light, photo sensor light, or both, or other sensor(s) Light function Which has one or more than one of the LED light-beam emit out from main or sides or top Or bottom of the said LED light device.

The current invention mainly to disclosure following features for below main application;

1. From FIG. 5, The plug-in outlet (5*n*) LED night light (500) has COB (5*k*) light source LED-unit(s) (5*i*), has;

At least one main LED-unit (5*j*) arrange within the LED light housing (5*a*) to emit the light beam to near-by location which is less than 20 feet and brightness is less than 100 CD.

The said main LED-unit (5*e*) has at least one of COB LED(s) (5*c*) as light source without focus optic-lens for illumination of near-by location(s) which is shorter than 20 feet and brightness is less than 100 CD.

The said LED light (500) is one of plug-in outlet (5*n*) night light to get AC power source from prong (5*n*) and through housing inner AC-to-DC circuit (not shown) or-and circuitry and controller to trigger the said at least one of COB LED(s) (5*c*)(5*k*) for desired light functions for indoor or outdoor application(s).

2. From FIG. 5, The Plug-In outlet (5*n*) or DC powered (5*r*) LED light (500) has more than one LED-unit(s) (5*j*) has At least one of main LED-unit(s) (5*f*) fit into LED main-housing (5*a*) has LED light source (5*c*) fit within to offer the near-by location illumination where is shorter than 20 feet and brightness is less than 100 CD not same as outdoor security light has move than 2,600 to 8,000 Lumens and distance is 30-100 feet.

At least one of side (5*j*) or top (not shown) or bottom (not shown) LED-unit(s) assemble with LED light main-housing (5*a*) by frame or bar or housing-parts.

The said each of side (5*j*) or top (not shown) or bottom (not shown) or other extra linkable side light which assembly with 1$^{st}$ side LED-unit(s) (now shown) has LED light source (5*j*) fit within to offer the other near-by location(s) illumination where is different location of main LED-unit location because the side or top or bottom LED-unit(s) face different with main LED-unit direction also can rotating to side or top or bottom . . . .

The said LED light is one of plug-in outlet (5*n*) light or DC powered light (5*r*) or transformer (5*q*) both belong to DC power source.

3. From FIG. 5, The Plug-In outlet (5*n*) LED light has at least one angle adjustable LED-unit(s) (5*j*) has;

At least one main LED-unit (5*f*) arrange within the main-housing (5*a*) of LED light (500) to emit light-beam to near-by area(s) where is different with outdoor high watt LED security light which has brightness over Min. 2,600 to 8,000 Lumens for distance min. 50 feet to 150 feet. The current invention only less than 20 feet distance for near-by location illumination and brightness is less than 100 CD. So totally different for High-Mounted on Top of Garage door or Roof corner than current invention for low-profits location of wall outlets location or connect with power strips outlets or put on desktop for DC operated unit.

At least one of side (5*j*) or top or bottom LED-unit(s) assemble with the main-housing (5*a*) to emit the light-beam to near-by area(s).

At least one adjustable angle construction (5*i*) here is bar for rotating, or remote control motor to adjust angle by wireless Wi-Fi, Z-way, Zig-Bee, RF or IR wireless system (not shown) to make the said side or top or bottom LED-unit(s) to change position, orientation, angle (as FIGS. 2 and 3 and 4 shown 2*a*, 3*e*, 4*g*) to make the side (1*c*)(2*a*)(3*e*)(4*g*)(5*j*)(6*j*) or top or bottom LED-unit(s) light-beam to emit to desired location which majority is different illumination locations of the main LED-unit (1*a*)(2*a*)(3*a*)(4*a*)(5*a*)(6*a*) of LED light (100)(200)(300)(400)(500)(600). It is appreciated the said main LED light-unit has alternative or replaceable or equal function for main LED-unit emit the LED light-beam to near-by location by the said indirect-light which the light is from the light-source (6*d*) which is not face the front area and the LED light-source is face down and the PCB of the light-source (6*d*) form a shade or cover to let light beam only show on surrounding ditch or groove or lower space for surrounding-light effects as shadow-area (6*m*) which is not direct light-beam as Top COB LED light source (6*n*) is face front for direct light-beam emit to front near-by locations.

From FIGS. 5 and 6, The said LED light (500)(600) is plug-in outlet (5*n*) night light for indoor or outdoor application with preferred circuitry and controller (6*e*) to turn-on and turn-off each or all or desired number or combination of LED light source(s) inside of the said main (5*f*) (6*c*), side (5*j*)(6*j*), top (not shown), bottom (not shown) by motion sensor (5*e*)(6*e*), power fail detector (6*h*), photo sensor (5*e*), pre-determined controller to get near-by location(s) with preferred illumination, functions for example function selection circuitry or-and switch (6*f*), camera with SD card or Wi-Fi with APP software for wireless transmitting digital data of image or sound or conversation to other receiver or LED light for setting, adjustable or desired function (6*g*), power fail or emergency or evacuation light function (6*h*), simple camera with SD card for storage captured image or sound or other digital data (5*h*), USB charger or USB input port, or USB power bank function (5*m*), color, brightness, kelvin temperatures color or assorted color(s), changing function, selected functions.

From FIGS. 5 and FIG. 6 can also see the said LED light is one of the prong (5*n*) plug-into outlet device, or AC-plug wire (5P) to connect with outlet of power strip or extension cord or generator for outdoor use, or power by DC battery for desk top or stair or multiple door areas application because the current invention can offer more than one of adjustable angle or position or orientation of LED light-beam emit direction. It is appreciated the said DC power not only limited for battery or energy storage device (5*r*) or outside transformer (5*q*) to supply the DC current, it also should cover the Power from solar, wind, chemical source and the saved into energy saving unit such as rechargeable batteries should also fall within the current invention.

4. From FIGS. 5 and 6, The Plug-In outlet (5*n*) LED light (500)(600) has at least one angle adjustable construction (6*i*) to make the angle adjust of the said LED-unit(s) (5*j*)(6*j*), has:

At least one main LED-unit arrange within the main-housing of LED light to emit light-beam to near-by area(s)

At least one of side or top or bottom LED-unit(s) assemble with the main-housing to emit the light-beam to near-by area(s).

At least one adjustable angle construction to make the said side or top or bottom LED-unit(s) to change position, orientation, angle to make the side or top or bottom LED-unit(s) light-beam to emit to desired location.

The said LED light is plug-in outlet night light for indoor or outdoor application with preferred circuitry and controller to turn-on and turn-off each or all or desired number or combination of LED light source(s) inside of the said main, side, top, bottom by motion sensor, power fail detector, photo sensor, pre-determined controller to get near-by location(s) with preferred illumination including direct light source (5*k*)(6*n*) or the indirect LED light source (6*d*), functions as above listed (e1 to e5), color including the cool to warm white or other amber color which good to help people to fall asleep and look like traditional incandescent bulb for color of light beam, brightness which can be low brightness such as less than 1 CD or low light brightness 10-20 CD or high brightness for 40-100 CD which can changeable or selected by pre-design switch or remote controller even had dimmable function changed by VR-kit (6*f*), kelvin temperatures color or assorted color(s) which mean the LED light has built-in many different color white from 2,500 to 6,500 from warm to cool white color range to let consumer to choice for each main or side or top or bottom LED-unit(s), changing function including hi-low brightness/motion or non-motion selection, selected functions (6*f*) or as above features (e1 to e5).

From the FIG. 1 is one of the preferred embodiments, show a (PP1) plug-in outlet or (PP2) battery powered or (PP3) AC plug-wire or (PP4) built-in LED light AC-to-DC transformer power or (PP5) USB related device connection powered or (PP6) outside transformer powered night time use LED light (100) for indoor or outdoor or camping or outdoor activities application.

The said LED light (100) has main housing (1*a*) in desired geometric shape or construction for examples the main-housing (1*a*) has bodies or frame (1*b*) on several place including right or left top and bottom so form two elongate or other geometric space to install two of the side-light-unit (1*c*). The side light-unit has built-in LED(s) or COB source (1*e*') which also can be dice or chip or dip inside (not shown) if incorporated opaque or white color lens or preferred optic-lens in front light-source(s) can make improve the brighter spot-light(s) issues for short distance, or dice or chip or dip LEDs need to have optics-lens or optics-light-medium to make the bright-spot light-beam by multiple reflection(s) and/or refraction(s) to spread out to evenly brightness passing out to outside LED light. However, to apply the COB LED (1*e*') which can reduce this headache bright-spot-light(s) issues because the COB LED (1*e*') can be any geometric shape such as round (1*e*') or rectangular (1*e*) with eye-catching Lemon-Yellow color or any desired colors with desired diameter, width, length, size or even can have certain flexibility type so even without the front opaque or while lens or optics-lens or optics-light-medium to spread out the strong spot-light beam to even brightness still is eye-catching. The COB LED (1*e*)(1*e*') for different geometric shapes also easily assembly with inner circuitry and work with controller to make desired near-by illumination.

From FIG. 1 the LED light has main housing (1*a*) has 2 side-light-unit (1*c*) and each side-light-unit (1*c*) has top and bottom two connect-bar (1*d*) to assembly with the main-housing (1*a*) and the two connect-bar (1*d*) allow side-light-unit (1*c*) to rotating to adjustable angle and fixed on desired angle so can allow the two side-light-unit(s) (1*c*) to emit the desired light-beam with desired color or changing color or different kelvin temperatures color of LED light beam to illuminate the area from LED light to pre-determined distance near-by areas.

The said LED type of the said side-light-units (1*c*) can any type of LEDs selected from Dip, Dice, Chip, or COB. The current invention preferred to use the COB (1*e*) or (1*e*') for simple assembly and simple to offer multiple areas or sections of the said side-light-unit (1*c*) to illumination such as 4 sides of the side-light-unit (1*c*). The said side-light-unit (1*c*) also can be top or bottom light-unit (not show). The said LED light also can be rotated from horizon to vertical or from vertical to horizon while the LED light has built-in rotatable prong. Further, the said main housing (1*f*) and frame (1*b*) and side-LED-light (1*c*) has plenty of space so can add at least one of additional functions may select from group of combination from;

(A1) wireless receiver(s) is one or desire combination select from IR, RF, Bluetooth, Z-way, ZigBee, Wi-Fi, Wi-Fi extender, download APP, or (A2) at least one of USB-port(s) of Type A, B, C, D, or other type USB-port(s) for output or input power, Outlet-port(s), Audio-port(s), or (A3) space for sit the be-charged products such as i-phone, i-pad, or (A4) Indicator light(s) to indicator power-status, surge on/off status, charging status, products location indicator light, or other purpose indicator light, or (A5) wire-arrangement including groove, ditch, catcher, holder, cut-out, pole or bar or frame in foldable or fixed type, or (A6) at least one of sensor(s) select from motion, moving, photo, sound, radar, heat sensor, or (A7) at least one of protection circuit select from surge, over-heat, over-charged, over-load, electric-shock, GFCI protection circuit and re-start circuit.

From FIG. 1, the LED light main housing (1*a*) has optional built-in main-light-unit (1*c*') to supply the front or arc areas light-beam to near-by areas. The main-light-unit (1*c*') can be fixed or detachable type or angle tilt to top, bottom, right or left to offer the desired areas for near-by illumination. It is appreciated the main-light-unit can has preferred LED light source including dip or dice or chip or COB LED(s) (1*e*') in desired specification, size, color, or multiple colors for one LED, or plurality of different color LED(s) to get different kelvin temperatures white LED including cool white or warm white colors between kelvin temperature color range from 2,500 to 8,000. It also appreciated the LED light optional has at least one of built-in additional function(s) (A1) to (A6) as above discussed.

From FIG. 1, the LED light main housing main-light-unit (1*c*') and two side light-unit (1*e*) connect with the circuitry (not shown) with or without IC and control unit which can be any function control unit as above discussed. By way of example and without limitation, such as the sensor (1*f*) which can be motion sensor, photos, radar, moving sensor or desired combination sensor(s), vibration sensor, sound sensor. However, one of ordinary skill in the art will readily appreciated that all kind of sensor, switch, power fail detector, always-on to trigger the said main-light-unit (1*c*') or two or more or top or bottom light-unit (1*c*) for desired LED light functions may one or more preferred functions selected from (e-1) color changing function: from one color to other colors, auto changing, select color, (e-2) change functions: from motion-sensor to non-motion sensor, or high-brightness to low-brightness, or (e-3) dimmable or adjustable light brightness function, (e-4) Power fail or emergency or evacuation light with or without flashlight functions (e-5) motion sensor light, photo sensor light, or both, or other sensor(s) Light function (e-6) Light performance including chasing, fade-in and fade-out, Auto color changing, Sequential, sound activated light, party light or other functions available from market Place.

The said night time or dark environment LED light of current invention at least have one of the side/top/bottom light-unit (1*c*) and the main light-unit (1*c*') has desired geometric shape and size and dimension and preferred lighted area(s) (1*c*)(1*c*') or sections(s) (1*c*') or bodies (1*c*) (1*c*') to offer more than one of the near-by illumination and power by preferred (PP1) plug-in outlet or (PP2) battery powered or (PP3) AC plug-wire or (PP4) built-in LED light AC-to-DC transformer power or (PP5) USB related device connection powered or (PP6) outside transformer powered for indoor or outdoor light which mainly has no focusing optic-lens to make the remote away location(s) for project light performance but the current invention may has high-power LED light-source which can illuminate the up to 1,000 lumens brightness.

The current invention is not high-power LED light source and the brightness is less than 1,000 lumens or more low brightness depend on what purpose some application for sleep light only 1 cd or brighter light only 40 cd.

However, one of ordinary skill in the art will readily appreciated that the current invention brightness should be fall within 1 to 1,000 CD which is big difference for market available for outdoor security light or security torch light with 2 or more adjustable angle light unit which has more than 2,000 up to 5,000 or 10,000 lumens. And current invention for the definition of near-by location(s) is only less than 30 feet can see the table or chain or pathway, the current invention brightness no need to see the coin on the floor under dark environment within 30 feet distance which is not for security light brightness standard. This is main difference with the market outdoor security light. However, the current invention can have desired for different brightness such as hi-medium-low or continuously dimmer switch to get the desired brightness by consumer while people needed for much bright or lower brightness.

From the FIG. 2 and FIG. 3 and FIG. 4 show the different LED light has more than one light-unit(s) to offer more than one near-by location illuminations and the said more than one of light-unit(s) can be fixed or movable angle or desired combination for more than one of the LED light-unit(s).

From FIG. 2 show the LED light (200) has the main housing (2*a*) has one of oval (dot line) shape or other preferred geometric shape and main-housing (2*a*) has dome shape motion sensor (2*f*) in front-surface, and inner has one of LED light source which can be dip or dice or chip or COB or other type LED light source, hereof preferred is COB LED(s) (2*d*) to emit the directly or indirectly LED light-beam to front near-by location(s) or surrounding groove or ditch of the said main LED-unit(s).

The said main-housing (2*a*) has housing-parts or frame or arms (2*b*) extend to two sides to assemble with side LED-unit (2*c*) and the said side LED-unit (2*c*) has built-in LED light source here for all figures preferred is COB LED(s) (2*e*) for simple installation, less soldering work, super slim thickness, eye-catching coating lemon-yellow color for all chip or dice LED(s) and emitting out area even brightness from coating surface. Wherein, one COB LED(s) has plurality number of LED dice or chip built-in so can prevent people see ugly PCB in brown or green or white fiber glass or other substrate PCB and less labor involved for manufacturing. All these features for desired brightness and even brightness created by COB LED(s) are much simple and nice and net and value appearance than the traditional plurality of dice(s) or Chips or Dip LED(s) which has big bright-spot issues especially for distance too short as FIGS. 2*d* to 2*a* from LED to top-lens, so non-COB LEDs need add optics-medium to make arrangement to eliminate the strong-spot-light(s) to even brightness or increase the distance from LED to Lens as FIGS. 2*d*-2*f* to get whiten or opaque top-lens has even brightness light-beam emit out.

From FIG. 2 the said main or side LED-unit (2*a*)(2*e*) has built-in COB LED(s) (2*d*)(2*e*) which offer the desired brightness and emit to front lens with or without optics-medium(s) for direct light or in-direct light-source(s). One of preferred embodiment(s), here the said side LED-unit (2*c*) also has the directly COB LED-unit (2*e*) to emit light-beam to front and also can emit light-beam to other direction while the side LED-unit (2*c*) rotate or tilt angle to the position (2*j*) where is 270 degree of (2*j*) [Dot line shape] position from the original face front (2*c*) [solid line shape]. Also, this change angle from right-side to front of side-LED-light instantly change the light-beam (2*k*) show the light beam is emit to 90 degree on right-side from front-position.

These light-beam (2*j*) from side LED-unit(s) emit to 270 degree location and light-beam (2K) from side LED-unit show 90 degree location and main LED-unit(s) has light-beam emit front location so the said LED light (200) has three lighted-location and these two side light-unit(s) can adjustable from Zero (fixed or permanently is fixed) to 360 degree on along the one of axis of X, or Y, or Z axis. While the said prong (2*h*) of the said LED light can be rotating, the said lighted-location and change to other axis such as from right-left to top-bottom so can even lighted the ceiling and floor after prong is 90 degree rotate or tilt so offer consumer the said front+right+left illumination or/offer consumer for ceiling+Floor+Front illumination. If the said side/top/bottom LED-unit(s) has linkable construction, the side light-unit(s) can become 2 or more on right or left or top or bottom . . . This is other features. It is appreciated all the ordinary skill of the market should still fall within the current invention and not limited for current invention for the shape, size, light source, angle adjustment, diameter (while is not oval shape for example is Round LED-unit) of the main or side or top or bottom LED-unit(s).

From FIG. 3 show the LED light (300) has main-housing (3*a*) has housing-parts (3*b*) to assemble the round shape side LED-unit(s) (3*e*). The said side LED-unit (3*e*) has the built-in desired LED light source and the light-source is arrange into the curve (3*f*) or sphere surface (3*f*) for certain purpose such as offer more wider illuminated-location(s) like (3*f*) or concentrate the LED light-beam as traditional skill of reflector shape (3*g*) or any other desired other shape for other purpose. It is appreciated have the alternative design such as FIGS. 7 (700) and FIG. 7E (7*b*) show the alternative only have single (700)(7*b*) round or bar or tube or elongate shape for single-tubular shape with front wide flat (7*k*) or curved illumination areas (7*k*). It is appreciated the shape can be any geometric shape and use single or two piece as current invention claimed LED light.

The said main-housing (3*a*) has built-in preferred LED light source here is COB LED(s) (3*c*) and has rotatable or adjustable prong. The circuitry or IC or electric parts & accessories (not shown) incorporate with wired or wireless controller here is a dome motion sensor or RF-receiver (3*j*) with other selector such as function selector (3*d*) which can have desired function choice from above discussed (e1 to e6) so can get pre-determined light functions.

While the side/top/bottom LED-unit has light passing material, those also can make the ball or other geometric shape side/top/bottom LED-unit(s) to glow while well design the LED light source light-beam arrangement.

From FIG. 3 also show the side/top/bottom LED-unit(s) need have freely rotating or tilting or move so the any geometric shape of side/top/bottom LED-unit(s) has to have enough distance (D) (3*i*) to away from the outlet location surface or wall to make freely rotating, move, tilting without touch the wall or surface of outlets existing place.

From FIG. 4 show the LED light (400) show the half-ball shape (4*g*) out of all geometric-shapes. The said main-housing (4*a*) has the built-in LED light source which is plurality of piece or colors or brightness or shape of LED chip, dice, dip or COB-LED(s) with front cosmetic-element or optics-medium or treated-lens or opaque-lens such as shaped opening(s) (4*c*), cutout(s) (4*c*), textured lens(es) (4*c*), color filter (4*c*), windows (not punch-through) (4*c*), stencil (4*c*), or opaque-treatment (4*c*) or white lens or plastic piece or painting (4*c*) but not a focusing element for projection light beam with optics focus properties existing.

From FIG. 4, the said main-housing (4*a*) has extend housing-parts (4*f*) to assembled moveable, adjust angle, rotatable Side or top or bottom LED-unit(s) (4*g*) each of the side/top/bottom LED-unit(s) has built-in desired LED light source (4*h*).

From FIG. 4 right side can see the half-ball (4*g*). From original face front and dome lens is emit light to arc range which position from clock dial face 21:00 to 03:00 range of near-by lighted location and rotated 270 degree (4*i*) the light-beam will emit the other arc lighted-location which position from Clock dial face 13:00 to 19:00 range.

The LED light (400) can be powered by prong (4*d*) or DC power source (4*e*) and the half-ball side LED-unit (4*g*) any position will away from the wall of outlet location because main housing has sufficient distance (D) from wall to the top of the side LED-unit highest points or housing. It is appreciated the said LED light (400) can have two side-light-unit(s) as night light and the main-light (4*c*) as power fail light while lost the home AC power source through power-fail circuit or system to operate desired function(s) including optional switch selection for Auto/Off/On selection or color selection or motion-sensor or dust-to-dawn functions for illumination.

From FIGS. 5 and 6 as above discussed for 4 main features of the current invention.

From FIG. 5 show the LED light has above discussed six preferred power source and has the main light (5C) for front or contour or surrounding light illumination as (6*m*) of FIG. 6. The said 2 or more side-light-unit(s) (5*j*) has its preferred dice(s), chip(s), COB LED light-source(s) (5*k*) for flat or straight or curve arrangement with or without optics-mediums or reflector or reflective and/or refractive optics-lens help to create the even brightness or directly light illumination. The said LED light (500) has at least 3 light-unit(s) to offer the front or sides or power fail light functions while incorporate with pre-determined circuit, IC, wired or wireless controller system and trigger system as above discussed features (a to f), addition function(s) (A1 to A6) or other functions needed. The said LED light (500) has built-in USB-port(s) (5*m*), IR (5*m*), RF (5*m*), camera related parts and accessories (5*h*), outlet(s) (5*h*'), photo-sensor (5*g*), other port(s) (5*h*") or sensor (5*e*) on the preferred main-body (5*a*), or at least one of rotatable side-housing (5*j*) with preferred fixed or rotatable prong-unit to change the LED light (500) from vertical to horizon installation and offer the light from Right-left to become Top-bottom arrangement with front direction light illumination. The said LED light (500) overall shape is ½ ball or dome shape back is flat and front is curved with desired radius.

From FIG. 6 show the more square or rectangular LED light (600) has the radius-corner for each rectangular main-housing (6*a*) and at least two side-LED-unit(s) (6*j*) which has sufficient space after installation for LED light-source(s), so each of side-LED-unit (6*j*) can have optional outlet(s) or USB-port(s) or sensor(s) or RF/IR/Zigbee/Z-way wireless receiver kits. The said main-housing has built-in LED-light-source which can be plurality of LEDs chips, dices, dip LED(s) and face outward to emit the light into groove, walls, ditch for surrounding illumination for one of in-direct light effects same as current inventor co-pending filed case (#HH-3) which is CIP of (#HH-2) which is CIP of (#HH-1) which is CIP of (#HH) for surrounding light effects made by plurality of LEDs emit outward to passing opening(s), grills, opaque-lens or wall, treated-lens(s), whiten or textures wall(s) to form the surrounding light with design or just light-brightness show on the inside the LED light ditch or gaps or groove or recess area(s) or the outside LED light housing for surround LED light to make wall illumination.

The LED light (600) has the built-in function selection system (6*f*), or camera with SD or Wi-Fi+APP (6*g*), or power fail light system (6*h*), or sensor systems (6*e*) to make desired function(s).

From FIG. 7 show one of alternative LED light (700) has base or holder (7*a*) to install the LED-unit (7*b*) by traditional angle adjustment skill or my magnetic-reaction force to fit the said LED-unit (7*b*) to make angle adjustment up to 270 degree as FIG. 7 shown. The LED-unit (7*b*) inner has built-in battery compartment to install preferred 3 pcs of AA batteries to supply power to the said built-in plurality LEDs with optics-medium to eliminate the plurality narrow emit-angle LEDs spot-light(s) to even brightness for wider viewing angle, or the said built-in LED light-source is one of geometric COB-sheet to go through the optic-medium or directly to emit to front opaque or whiten or texture or treated lens to show even brightness LED light brightness to outside LED light as FIGS. 7, 7A, 7B, 7C shown. The said angle adjustment by magnetic-reaction between the magnetic-piece(s) install inside the tray or holder (7*a*) and conductive-parts of battery housing (7*j*) while the batteries installed inside the LED light-unit (7*b*). One of preferred shape or construction of current invention is tube, cylinder, bar, pole, round tube shape which can fit into bigger diameter round base or holder so can easy to attached basing on sufficient force of magnetic-reaction and stay on angle because the conductive-body of battery is 360 degree without the polarized so wherever reacted the magnetic-force will instantly assembled with the base on that angle so people can simple to hold the LED-unit on preferred orientation so can fix the preferred angle within 270 degree as shown on FIGS. 7A, 7B, 7C from center orientation (7B) to top and bottom each around 135 degree or other preferred angle for adjustment. This offer people a very good and simple installation better than traditional skill to make mechanical construction with teeth or level or hinge to change the light emitting angle. This is big improvement and save a lot of tooling and material and assembly labor concept.

From FIG. 7D show the base or holder (7*a*) brief and preferred shape. The base or holder (7*a*) the receiving area is one curve or radius which is litter bigger diameter than the diameter of the said LED-unit(s) so can receive the round or tubular or cylinder or bar construction LED-unit very simple and quick. The said frame or base or holder (7*a*) has built-in sufficient magnetic-piece inside the number can be at least one to N (N—is any number). In order to the said base or holder (7*a*) can fix on the any surface can use at least one of traditional kits select from (1) nail, screws, (2) glue, chemical glue, (3) tape, form-tape, Velcro-tape, 3M tape, (4) magnetic-piece, (5) other adhesive material, (6) preferred super glue or others; to install the base on preferred location and orientation. The built-in magnetic-piece(s) has sufficient magnetic force which can hold tightly of the said full-loaded batteries weight of the said LED light-unit and stay well without fall-down or any deviation position and can overcome the vibration, heat, shaking.

The said LED light-unit one arc or one section of the outer circle arrange the illumination lens (7*d*) with desired thickness such as 4 mm and width such as 35 mm and length such as 150 mm. The LED light-source can be (Optics-1) plurality of dice or chip LED(s) arrange to align with the length wall and each LED light-beam emit into the optic-medium lens and go through multiple times reflected and refractions and emit out from front of the optics-medium lens which is same as the said co-inventor co-pending (#R-6)(#R-5)(#R-4)(#R-3)(#R-2)(#R-2007) and issued patents of (#R-1) as above filing history shown all U.S. Application Series. No and filed date. Also, this arrangement also same as co-inventor co-pending (#UU-2) and its parent (#UU-2010) as above filing history details data. Or, (Optics-2) The said LED light-source is at least one of LED COB-piece (7*e*) which same as above arrangement (Optic 2-1) fit and align the length wall which is 4 mm thick and 150 mm long and let the COB light-beam emit into the optics-lens optic-medium and go through multiple times reflected and refraction within the said optics-medium material or optic-lens and emit out from viewing surface, or (Optics 2-2) fit the LED COB light-piece lower than the position of front-lens which can be (2-2*a*) clear lens so can clear to see COB-piece light-beams while light is ON or see pretty COB-piece surface colorful appearance while no light output.

(2-2*b*) the front optic-lens is opaque or whiten or textured or treated so the COB light-beam will become more wider and more even brightness. This kind of arrangement no need any optic-medium to make multiple reflection and refraction within the optics-medium of optic-lens. The multiple reflection and refraction happen within the front lens and LED-unit(s) inner walls not within the optics-medium of optics-lens.

From FIGS. 8, 8A, 8B show co-pending (#UU-2) drawing which the FIG. 8 show one of DC battery powered the small less than 4 inch diameter punk light having 3 pcs AA or AAA batteries, or 4 to 6 inch diameter tap light having 3 AA or 3 Sub-C or 3D battery, or 6 to 12 inch diameter ceiling light has 3-8 pcs of C or D size batteries application with top-lens which has opaque or whiten or texture or treated top-lens (03) has top-cover (02) to assemble with top-lens, and top-cover assembled with the base (01). The said LED light bas (01) has preferred circuit and having as least one of trigger-system or switch or sensor or wireless receiver unit to make the said mechanical or wireless to turn-on and turn-off LED(s) for desired illumination with all desired functions as above discussed (A1 to A6) or features (a to g) and some trigger-system shown on FIG. 8C and FIG. 8D as LED(s) triggered by ate least one of RF/IR/Blue tooth, motion/moving/photo/radar sensor(s), other(s) sensor(s), Wi-Fi and download APP software, or wired and wireless control system.

From FIG. 8A show the LED light-source(s) VS top-lens related position and the distance is key to make a good even brightness or bad strong brightness spot-light(s) light effects. The FIG. 8A show the LED is put on inner-surface of base so have distance to top-lens is (D) and that is sufficient to make the LED light-beam make multiple times reflected and refraction between the inner-housing and top-lens inner surface and also the opaque or whiten or milky lens help to eliminate the spot-light(s) to even brightness.

From FIG. 8B show the distance from LED(s) to Top-lens is (*d*) which is not enough to eliminate the spot-light even still go through the top opaque or whiten or textured or treated lens still can not eliminate the strong-spot light effects.

From FIGS. 7-8, 7-9, 7-10, 7-11 show the co-inventor co-pending (#DD-1) for battery powered punk light, tap light, ceiling light which is same as the parent (#DD-2008) and (#CC-1) and (#CC-2008) filed case as above discussed filing history with all details U.S. Application Series Number and filed date. It is appreciated all above listed or discussed for current invention and co-pending case(s) all the concept, idea, construction, claims, text should be still fall within the current invention scope and claims coverage.

From FIGS. 7-8, 7-9, 7-10, 7-11 has built-in one push-on/off switch under the top-cover which at least to turn off the LED light for illumination any time priority than any other functions while people do not want to light function(s) at any time.

From FIGS. 8, 8A, 8B, 8C, 8D show the co-pending (#UU-2) U.S. application Ser. No. 15/472,698 filed on Mar. 29, 2017 for puck/tap/ceiling light has plurality at least one color LED(s) put on preferred distance (D) to make the light-beam emit from plurality of LEDs directly to the top whiten or opaque lens without super-bright spot-light(s) because the light-beam have traveled within the inner space and have multiple-time reflection and refraction between the inner housing parts and top-cover and top opaque or whiten lens so eliminated the spot-light(s) to become even brightness light-beam emit out from top-lens as above discussed.

From FIGS. 9, 9A, 9B, 9C show one of co-pending parent filed case (#UU-2010) drawing as above listed filing history which is CIP of parent filed case (#RR-10)(#57) U.S. application Ser. No. 12/149,963 filed on May 12, 2008 which is CIP of (#Z-08)(#50) U.S. application Ser. No. 12/149,963 filed on May 12, 2008 which is CIP of (#Y-08)(#44) U.S. application Ser. No. 12/073,095 filed on Feb. 29, 2008 which is CIP of (#X-08)(#81) U.S. application Ser. No. 12/073,889 filed on Mar. 11, 2008 which is CIP of (#W-08)(#43) U.S. application Ser. No. 12/007,076 filed on Jan. 7, 2008 which is CIP of (#V-08)(#42) U.S. application Ser. No. 12/003,691 filed on Dec. 31, 2007 which is CIP of (#T-08)(#68) U.S. application Ser. No. 12/894,865 filed on Sep. 30, 2010;

those parents filed case related the LED light-bar or LED Light-bar with built-in outlet or USB with (1) movable LED-unit(s), or (2) extendable or retractable LED-unit(s), or (3) transforming shape or construction LED light-unit of LED light-bar assemblies.

The current invention improved the said LED light-source to chip or dice or CBO LED(s), so can incorporated above discussed (1) optic-medium to make light-beam travel within for multiple times reflection and refraction and emit out from the treated optics-lens which may be in whiten or opaque or textured or other treatment(s), or (2) incorporate with simple soldering work, less labor, super slim COB (Chips-on-board) LED light source(s) to make direct or indirectly light-beam to go through the clear or treated top-lens.

From FIG. 9 can see the one of preferred transforming shape LED light-bar assembly (900) which has 3 bars (9*a*)(9*a*')(9*a*") and assembled together by rotating-pole or hinger or other alternative or replaceable traditional skill to make the 2 bars (9*a*')(9*a*") can change angle at least can change 90 degree such as from vertical to horizon or from horizon to vertical. Each of the bar (9*a*)(9*a*') (9*a*") can have same or different LED light-source(s). One of preferred examples but not limited as bar (9*a*') has plurality of LED(s) under a clear top-lens to emit the super bright spot-light(s) out, or as center bar (9*a*) and right-hand bar (9*a*") both has 2 round or donut shape COB LED light source(s).

Figures 9, 9A, 9B, 9C:
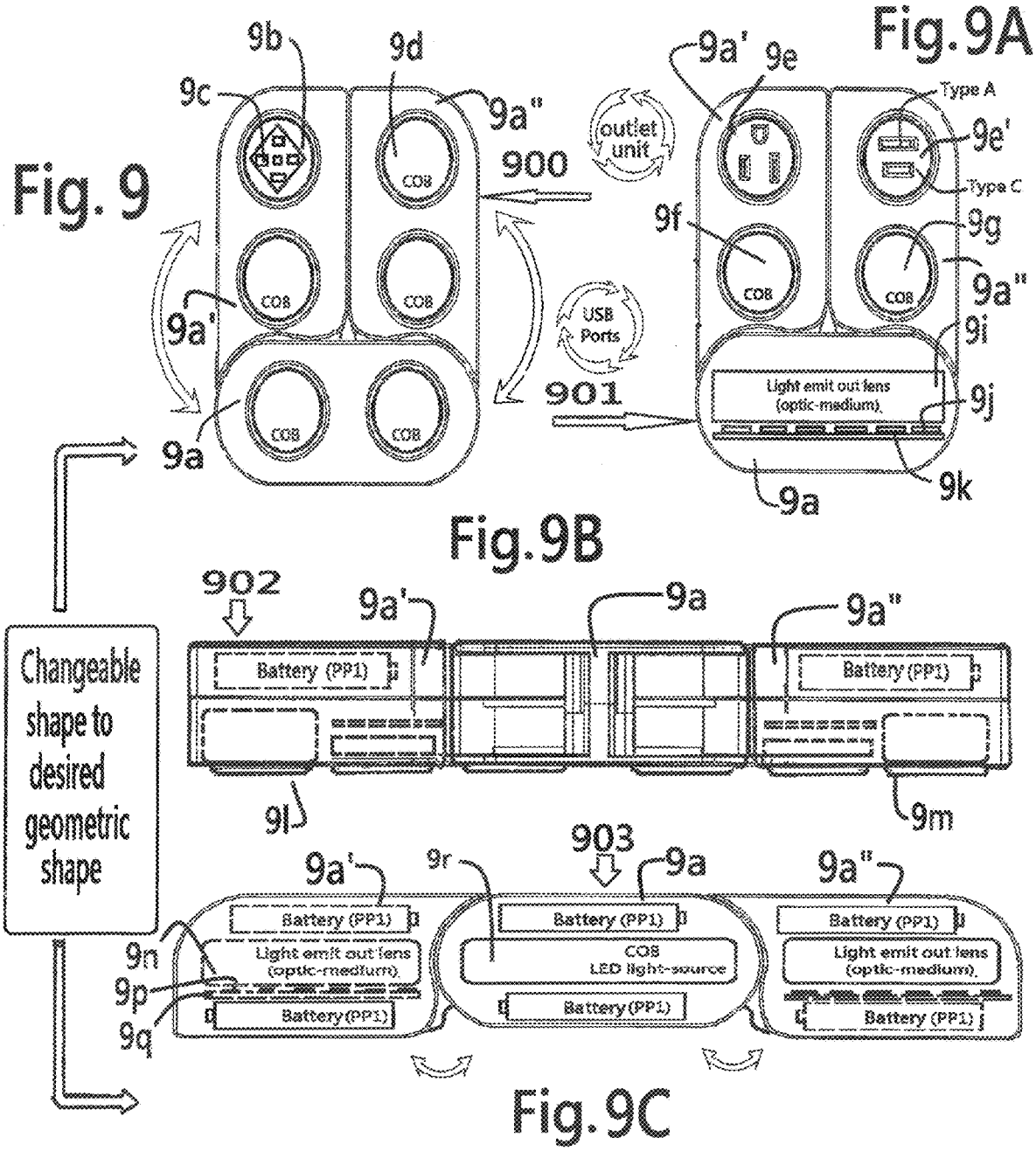

From FIG. 9A show the one of alternative or replaceable arrangement for LED light-bar assembly which not only have different LED light-source including (i) round or donut shape COB (9*f*) fit within bar (9*a*') and COB (9*g*) fit within bar (9*a*"), or (ii) plurality of chip or dice LED(s) (9*j*) bonding on narrow-strips PCB (9*k*) and face the long-side of optic-medium (9*i*) wall to emit light-beam into the optic-medium (9*i*) and light-beam travel within the said optics-medium (9*i*) for multiple times reflection and refraction within the inner space to eliminate the sport-light(s) to even brightness light-beam emit out from whole display-areas or said 90 degree of the said optic-medium width×length surface.

From FIG. 9A also show the two top-area(s) of bar (9*a*) and bar (9*a*") each have built-in outlet (9*e*) and USB-port(s) (9*e*'). The said outlet (9*e*) is one of rotatable outlet. The said USB-port(s) has type C and/or type A for input and/our put DC current without digital data delivery and the USB charging-ports can have quickly charging capacity from 15 Watt, or from 20 Watt, or from 30 Watt, or from 40 watt to quickly charge the be-charged device.

From FIG. 9B show the said one of preferred embodiment for FIG. 9A having the outlet (91) on left-end and USB-port(s) (9*m*) on other-end while the LED light-bar assembly 2 side movable bar (9*a*') (9*a*") change from vertical position to horizon position for form a linear LED light-bar in straight shape, so can let house owner to illuminate more wider-area than the original shape or construction as FIG. 9 or 9A for illumination length.

From FIG. 9B also show the DC powered LED light-bar assemblies (9020 has 3 bars (9*a*')(9*a*" (9*a*") have built-in batteries and the space for two ends outlet (91) and USB-port (9*m*) to install parts within the thickness and has preferred plurality LED(s) on PCB and light-beam emit out from plurality of LEDs into narrow thickness of the optic-medium so can make all even brightness light-beams shown on the 90 degree of the path of LED light-beam traveling.

While the said LED light source change to the COB for super thin light-source and without the outlet and USB-port for inner big-parts, the said LED light-bar assembly (902) can instant to become super slim LED light-bar assembly as show on FIG. 10B. Also, some of preferred embodiment for super thin COB light-bar assemblies show on the FIGS. 10C, 10D, 10E, 10F has different shape and size COB light-source so can make like one linear light-tube or 6 of super-bright torch-light with (PP1) directly plug-in outlet to get AC powered source or (PP3) incorporated with AC-plug-wire to insert male AC-plug into outlet to get AC power source as FIG. 10E.

(PP2) built-in batteries for DC powered as FIGS. 10C, 10D, or (PP4) built-in LED light AC-to-DC transformer power to change input AC to D, or (PP5) USB related device connection powered has USB-plug wire to delivery power, or (PP6) outside transformer to supply DC current to assembly through quick or plug sets or AC plug-wire.

From FIG. 9C show all details for LED light-bar assembly has 3 bars (9*a*)(9*a*')(9*a*") all in horizon position to form a straight shape with build in batteries to supply power and go through at least one of inner circuit and/or IC and/or wireless trigger-system and/or switch and/or sensor-system to make the said at least one of COB, plurality of LED(s) with or without the optic-medium to make the desire LED illumination to be seen and illuminate desired area(s) for pre-programed light function(s), effects(s), performance(s), duration time.

From FIG. 10 and FIG. 10A show the different LED light-source and outlet and USB-port arrangement. Here, prefer to use the COB light source because it is super thin and easy to solder few points can get same effects than plurality of LED(s) on PCB which even use the automatically bonding machine which still need pay for bonding labor and machine cost which is too costly and need optic-medium and more labor for assembly. From FIG. 10 show only need 3 pcs elongate COB-piece can make so pretty linear light-performance as FIG. 10C show for super low-cost and super simple and super cheap labor. From FIG. 10D show while LED light-bar assembly do not incorporate with outlet or USB-port(s) it can use all round or donut or multiple-circles COB piece(s) arranged as FIG. 10D which will be like 6 halogen or 6 super bright LED-unit same effects but with super slim and super low cost basing on almost few step can assemble into one finish-product. Further while incorporate with at least one of Outlet or USB-ports with round, circles, donut COB piece or Plurality of LEDs with or without optic-medium still can make so pretty light for people to get 2 choice for short/wider illumination or get triple-length longer illumination areas from one LED light-bar assembly for transforming features are the current invention and parent co-pending and issued patents big improvements.

From FIGS. 11, 12, 13, 14-1 to 14-5 show all the same concept for LED light-bar assemblies has geometric shape of bar (30)(31)(32) or bar (40)(41)(42)(43) which can change from Triangle FIG. 11 to straight-shape FIG. 12. The detail how to do shown on the FIG. 13 step by step. From FIG. 14-1 to FIG. 14-5 show the 6 pcs of LED-Units and each one can assembly like LEGO toys to make any geometric shape and each of LED-units has use individual self-power and linkable with each other to share the each self-power under IC and program design so do not make battery life to become shorter while join-with other linkable other LED-unit(s).

From FIGS. 15A, 15B, 15C, 15D show the co-pending parent filed case (#II-4) U.S. Ser. No. 16/032,664 which the said LED light-bar assembly. From FIG. 15A show LED-unit or LED-bar have COB light-source(s) (52*a*) and (52) which controlled by wireless receiver or sensor or switch to make each COB light-source to make pre-determined LED light functions as above discussed (e1) to (e6) or other market available LED light functions.

From FIG. 15B show the LED light-bar assembly controlled by wireless remote controller (53*d*) with preferred setting, adjustment, selection, on/off power and other market available key-pads to make desired functions. The remote controller as above discussed for many types and one of preferred embodiment(s) as show on FIG. 15B the remote controller (53*d*) is RF remote controller has its wireless signal transmitting range such as 400 Feet or 180 meter or whatever depend on the design of power and circuit. The RF remote controller has effective signal transmitting range such as show on center drawing so can transmit signal to LED-unit (53A) by RF receiver (53R) and it also has its own transmitter-kit (53T) to transmitting signal to other LED-unit (53B)(53C) because the remote controller (53*d*) is not powerful enough to transmit the signal to the LED-unit (53B)(53C) because both locations is outside the effective transmitting-range. So, need the LED-unit (53A) to transmitting signal while people have a big garden or big house for indoor or outdoor applications.

From FIG. 15C show the same as FIG. 15B for different LED-unit(s). From FIG. 15 is show one of garden or pathway light system which is also control by RF remote controller to make pre-program LED light functions.

FIG. 16 show the one of co-pending filed case with extendable LED light-bar assembly which has built-in plurality of LED with optic-medium to make multiple time reflection and refraction within the optic-medium which also is top-lens and after multiple reflection and refraction (909) eliminated all strong spot-light(s) and create a very even brightness area or surface light-beam emit out from optic-medium (908). Or, the light-bar or LED-unit (901)(902)(903) has built-in simple installation and less labor LED COB-piece(s) which may in different shape, color(s), size and brightness as (903')(904")(905')(906')(907'). The said LED-unit(s) or light-bar (901)(902) (903) also can have built-in different sensor(s) (901") or trigger-system(s) or wireless receiving or transmitting kits (901') to make wireless triggered by sensor(s) or trigger-systems select as above discussed at least one of IR, RF, Blue-tooth, Z-way, Zig-Bee, Wi-Fi with download APP go through 3/4/5/6G systems or internet or cloud or storage-device or server(s) to make remote controlling or remote triggering functions or selection or setting or adjustment . . . etc.

FIG. 16A show the alternative arrangement for extendable and retractable or transformable LED light-bar assembly which can change length for narrow WW shape to wide opening or even to full straight-shape to become much longer length to offer the much longer areas for illumination such as from FIG. 16 85 cm to FIG. 16A 155 cm, so this is one of the features for current invention for extendable or retractable or transforming to change the each LED-unit(s) or light-bar(s) LED light-source related position, orientation. From FIG. 16A can see the many light bars (1000) and each one have desired plurality of LED with optic-medium or simple geometric-shape of CON as light-source(s) such as rectangular-shape (1011)(1013)(1015)(1016) so while WWW shape to change to full-straight shape it will be like a long light-bar and each rectangular-shape COB(s) offer a pre-determined lighted-area. The said LED light-bar assembly also has built-in sensor(s) (1005') or wireless triggers.

The current invention for COB Light-light source and LED light source also is CIP of the co-pending (#JJ-3) U.S. application Ser. No. 14/9,790,747 Filed on Dec. 28, 2015

Which CIP of (#JJ-2) U.S. application Ser. No. 14/604,206 Filed on Jan. 23, 2015, now U.S. Pat. No. 9,163,799

Which is CIP of (#JJ-1) U.S. application Ser. No. 13/534,281 Filed on Jun. 27, 2012, now U.S. Pat. No. 8,960,988 claim 1 for power saving features.

Which is CIP of (#JJ-2010) U.S. application Ser. No. 12/710,561 Filed on Feb. 23, 2010, now U.S. Pat. No. 8,303,158

Which is Division of (#00-2010) U.S. application Ser. No. 12/711,456 Filed on Feb. 24, 2010, now is U.S. Pat. No. 8,083,376. Claim 14 for power saving and claim 15 for cost saving features.

Which for apply the eye's persistence of vision theory to make a quickly flashing which people eyes See continue turn-on but it actually having predetermined percentage is turn-off of each cycles, So can save a lot of power for power saving functions. Also, the co-pending parent filed case also Teach cost saving to incorporate with boost-voltage circuit to raise the lower voltage of total rechargeable or non-rechargeable batteries to sufficient higher voltage to trigger the said at least one of LED light-source(s). The current invention to incorporated COB light-source which had big improvement than chip or dice or surface-mounted LED technical because COB is easily to use for even brightness, no bonding extra labor and no extra PCB cost, having heat-sink on back substrate and super brightness because having diffusion coating layer to eliminated spot-light(s) so easily to incorporate front opaque or milky or whiten lens within shortest distance or even can attached on surface so this is big improvement than market surface-mounted LED chip, dice.

From above discussed LED-unit(s) or LED light-bar assembly has desired function(s), colors, brightness, light performance, effects have below (18) features and each one is supported by related drawing and above abstract or background or brief description and details description and all above listed co-pending filed case and parent filed cases. It is appreciated any concepts, idea, construction with its alternative or replaceable or equal functions still should be fall within the current invention scope and claims coverage without exception and argument;

1. The DC powered has remote control LED light-bar assembly, consist;

At least one LED(s) or COB LED light-source(s) arrange within DC powered LED-unit(s) of LED light-bar assembly to emit the light beam to desired area(s) by angle adjustable-kit.

The said LED light-bar assembly has IR or RF system to control at least one of light-unit(s) to operate the pre-determined function(s), color, brightness, operation time-period, adjustment, setting. and The LED light-bar assembly has separated base or holder with height adjustable and locking-height-kit and at least one of magnetic-piece(s) fit within to make magnetic-reaction with metal-piece(s) inside the LED-unit(s) to (1) hold the LED-unit tightly and (2) change light-beam emit-angle of LED-unit(s); by magnetic reaction-force.

The said base or holder install on desire surface(s) by adhesive or installation or magnetic kits.

2. The DC powered remote control LED light-bar assembly, consist;

At least one LED(s) or COB LED light-source(s) arrange within DC powered LED-unit(s) of LED light-bar assembly has more than one color(s) or brightness(s) or functions to emit the light beam to desired area(s).

The said wireless remote control at least including IR or RF remote-system to control at least one of LED-unit(s) of LED light-bar assembly.

The LED(s) or COB LED light-source(s) emit even brightness light-beam to be seen for at least one or more than one pre-determined (1) function(s), (2) color, (3) brightness, (4) operation time-period, (5) adjustment, (6) setting, (7) different white color(s) including warm-white, cool-white, (8) function-selection between motion, dust-to-dawn, hi-low brightness, time-count-down, (9) chasing or sequential or fade-in and fade-out or color-changing or color-selection light-effect(s), and 3. The DC powered remote control LED light-bar assembly, the said metal-piece(s) inside the LED-unit(s) is at least one or more than one of battery which has metal body to create the reaction of magnetic-force with at least one of magnetic-piece(s) fit within the said holder or base.

4. The DC powered remote control LED light-bar assembly, the said LED light has more than one of LED-unit(s) and its base or base to offer the more than one location for illumination.

5. The DC powered remote control LED light-bar assembly, the said LED-unit(s) can change light-beam emit direction by simple change LED-unit(s) position or orientation without any mechanical construction needed.

6. The DC powered remote control LED light-bar assembly, the said the said LED-unit(s) has built-in LED light-source selected from dip, dice, chip, COB LED(s) for one or more than one color LED or plurality of different color LEDs.

7. The DC powered remote control LED light-bar assembly, the said LED light controller is at least one of the sensor(s), motion sensor, radar sensor, photo sensor, vibration sensor, heat sensor or power fail detector to trigger the said LED light source(s) to turn on and turn off basing on predetermined LED light performance or effects or functions.

8. The DC powered remote control LED light-bar assembly, the said LED light-source is COB light source in desired geometric shape, brightness, color combination, flexibility, lumens, coating colors.

9. The DC powered remote control LED light-bar assembly, the said wireless controller is at least one of system(s) select from (i) IR or RF, (ii) blue-tooth, (iii) ZigBee, (iv) Z-way, (v) Wi-Fi, (vi) Wi-Fi extender, (vii) download APP, (viii) sensor(s), (ix) radar-detector(s), (x) internet, (xi) 3/4/5G, (xii) other wireless plate-form(s) to setting, adjusting, changing, selection the at least one of light-bar assemblies for desired color, brightness, duration, operation time-period(s), sensor distance, on/off, dynamite function(s), sequential function(s), light-effect(s), light-performance.

10. The DC powered remote control LED light-bar assembly, the said LED light main LED-unit has desired one of more than one assorted function selected from (e-1) color changing function: from one color to other colors, auto changing, select color, (e-2) change functions: from motion-sensor to non-motion sensor, or high-brightness to low-brightness, hi-medium-low or continuously changing brightness, or (e-3) dimmable or adjustable light brightness function, (e-4) Power fail or emergency or evacuation light with or without flashlight functions (e-5) motion sensor light, photo sensor light, or both, or radar sensor, moving sensor, or other sensor(s) Light function (e-6) Light performance including chasing, fade-in and fade-out, auto color changing, Sequential, sound activated light, party light or other functions available from market Place.

11. The DC powered remote control LED light-bar assembly, the said geometric-shape is one of tube, bar, pole, cylinder, polygon, or elongate shape.

12. The DC power remote control LED light-bar assembly, the said remote controller can control more than one of LED light-bar assemblies from one of remote-controller.

13. The DC power remote control LED light-bar assembly, the said magnetic reaction-force alternative between the base or holder built-in magnetic-piece(s) and the metal part(s) built-in the said each LED-unit(s).

14. The DC power remote control LED light-bar assembly, the said adhesive kits is at least one of glue, tape, form-tape, Velcro-tape, super-glue, nail, screw, phone-holder kit(s), chemical compound(s), 3M tape, or other traditional adhesive kits, or magnetic-piece to install on desired surface(s) where is at least one of under-cabinet, closet, cabinet(s), drawers, garage, patio, garden, fence, walls, under-table, under-bed, under-sofa, under-chair, or other home space needed the light-illumination.

15. The DC power remote control LED light-bar assembly, the said DC power source alternative is one of (i) battery or (ii) built-in LED light-unit AC-to-DC transformer or (iii) USB related device connection or (iv) outside LED light-unit AC-to-DC transformer; to supply the DC current to at least one of LED-unit(s).

16. The DC power remote control LED light-bar assembly, the said wireless system that including wireless receiver-unit and wireless transmitting-unit which received wireless-signal from remote-controller $1^{st}$ transmitting-signals and also transmit the $2^{nd}$ transmitting-signal to other near-by other light-bar assemblies those location(s) are far-away or beyond the remote-controller $1^{st}$ transmitting-signal can reach range for big home or garden or indoor or outdoor area(s).

17. The DC power LED light have sensor(s) trigger-system and angle adjustment by magnetic reaction-force, consist:

,

At least one LED(s) or COB LED light-source(s) arrange within geometric-shape LED-unit(s) of LED light to emit the light beam to desired area(s) and LED wireless trigger-system is at least one of sensor(s) select from motion, photo, moving, radar, heat, gas, smoke, sound, CO1 sensor not including IR or RF sensor(s).

The said LED light incorporate with IC and related circuit to create at least one of pre-determined function(s) at least including at least one of (i) Changing or select the color(s), color changing, color selection, auto changing color.

(ii) adjust or select or mixing operation time-period, angle, brightness, color, sequential.

(iii) setting, select sensor distance or range or height, sensitivity.

(iv) select functions including select motion, or dust-to-dawn, or other sensor(s).

(v) incorporate multiple position manual-switch to select on/off/Auto function LED-unit(s).

(vi) LED light has timer count down circuit to turn off the LED illumination for pre-determined period of time after triggered, and The LED light-bar assembly has separated base or holder has at least one of magnetic-piece(s) fit within to make magnetic-reaction with metal-piece(s) inside the LED-unit(s) to (1) hold the LED-unit tightly and (2) change light-beam emit-angle of LED-unit(s); by magnetic reaction-force.

The said base or holder install on desire surface(s) by adhesive or installation or magnetic kits.

18. The DC power LED light-bar assembly have sensor(s) or wireless trigger-system and transforming construction(s), consist:

At least one LED(s) or COB light-source(s) arrange within DC powered LED-unit(s) of LED light to emit the light beam to desired area(s).

The said LED light-bar assembly has at least one of sensor(s) or wireless-system(s) to operate the pre-determined function(s), color, brightness, operation time-period, adjustment, setting. and The LED light-bar assembly has more than one of bar(s) or tube(s), housing(s), elongate piece(s), or compartment(s) assemble together to make at least one of (1) extendable, (2) retractable, (3) transforming;

shape from $1^{st}$ to $2^{nd}$ or more different shape(s) or construction(s) to change the at least one of LED(s) or COB(s) LEDs relative relation(s), position(s), orientation(s) at least in one of X, Y, Z axis to get $2^{nd}$ or more different illumination areas, size, length, width.

The said LED light-bar assembly is for indoor or outdoor or both indoor or outdoor application, and install on desire surface(s) or substrate(s) or housing item(s) by at least one of adhesive, installation kits, magnetic kits, or traditional skill.

Wherein the DC power source is at least one of (i) battery or (ii) USB related device or (iii) outside LED light-unit AC-to-DC transformer (iv) solar power and power from DC storage device Wherein, the said functions at least including one or more from (e-1) color changing function: from one color to other colors, auto changing, select color, (e-2) change functions: from motion-sensor to non-motion sensor, or high-brightness to low-brightness, hi-medium-low or continuously changing brightness, (e-3) dimmable or adjustable light brightness function, (e-4) Power fail or emergency or evacuation light with or without flashlight functions (e-5) motion sensor light, photo sensor light, or both, or radar sensor, moving sensor, or other sensor(s), (e-6) Light performance including chasing, fade-in and fade-out, auto color changing, Sequential, sound activated light, party light or other functions available from market Place.

(e-7) at least one of additional functions select from N-number (N is any number) of (i) USB charging port(s) to charger, (ii) Outlet to supply AC power to other products, (iii) quickly charging system from 31 Watt to 60 Watt output from USB charging-port(s) for single or multiple USB-port(s) to share.

(iv) wireless receiving and transmitting kits built-in at least one of LED-unit.

The current invention for COB Light-light source and LED light source also is CIP of the co-pending (#JJ-3) U.S. application Ser. No. 14/9,790,747 Filed on Dec. 28, 2015

Which CIP of (#JJ-2) U.S. application Ser. No. 14/604,206 Filed on Jan. 23, 2015

Which is CIP of (#JJ-1) U.S. application Ser. No. 13/534,281 Filed on Jun. 27, 2012

Which is CIP of (#JJ-2010) U.S. application Ser. No. 12/710,561 Filed on Feb. 23, 2010

Which for apply the eye's persistence of vision theory to make a quickly flashing which people eyes see continue turn-on but it actually having predetermined percentage is turn-off of each cycles, So can save a lot of power for power saving functions. Also, the co-pending parent filed case also Teach cost saving to incorporate with boost-voltage circuit to raise the lower voltage of total rechargeable or non-rechargeable batteries to sufficient higher voltage to trigger the said at least one of LED light-source(s). It is appreciated all the co-pending or parent filed case all concepts, idea, constructions, claims of above discussed with alternative or replaceable or equal functions should still fall within the current invention scope, claims coverage.

19. A COB light device having power saving features, comprising;

At least one COB LED to serve as a light source;

At least one housing having space to install circuitry including at least one of IC, AC-to-DC circuit is built-in or inside external transformer, switches, sensors, trigger system, RF or IR remote control system to turn-on and turn-off COB light-light source according predetermined functions, effects, on/off timing or percentage of each cycles, color, brightness.

The power saving features including the at one of COB light-source(s) being arranged to turn on and off for predetermined percentage of turn-on and turn-off of each cycle, and The said frequency of the cycle is faster than an eye's reaction time casing a persistence of vision effects so that the at least one of COB light-source(s) appears to be continuously on and the resulting flashing is not visible to an observer.

20. A COB LED light device having cost saving features, comprising;

At least one COB light-source to serve as light source.

At least one housing having space to install at least one of battery and circuit including IC, AC-to-DC circuit is built-in or inside external transformer, switches, sensors, micro controller, wireless trigger system, IR or RF remote controller to turn on/off the said COB light-source(s) for predetermined functions, effects, on-off timing or percentage, color, and brightness, and Wherein the said battery or a combination of batteries-assembly total voltage is lower than the COB light-source trigger voltage and said circuitry includes a voltage boosting-circuit to raise the battery or a combination of batteries-assembly total voltage up to the battery trigger voltage.

21. A COB LED power fail light, comprising;

At least one COB light source(s) serve as light source,

At least one COB(s) or surface-mounted LED(s) or both COB(s) and surface-mounted LED light source(s) as arrange for (1) night time use lighting and (2) power fail light illumination.

At least one prong or AC-plug-wire or outside transformer to connect with home AC power source to AC-to-DC circuit built-in power fail-light or external transformer to offer the DC current to internal circuit, IC, sensor, trigger-system, IR or RF system(s) to create predetermined night time use lighting and power fail light functions, effects, colors, brightness, manual selection for function, color changing, color selection, Motion or dust-to-dawn, hi-low brightness.

At least one rechargeable or non-rechargeable battery fit within the power fail light housing to supply the power while lost AC power with or without USB-port(s) to input or output power.

It is appreciated all the alternative or replaceable or equal functions for the above discuss the LED light, LED-unit, LED light source, circuitry, controller, functions, color, moving, fixed prong, rotating prong or movable sensor, adjustable LED-unit(s) light-beam emitting angle or other ordinary skill in the art should still fall within the current invention scope and not limited for disclosure drawing, details specification.

The invention claimed is:

1. A DC battery powered LED light bar movably mounted on non-heat sink base by a magnetic piece in one of the light bar and the base, and at least one metal piece in the other of the light bar and base, comprising:

a plurality of LED light sources on a circuit board included in the LED light bar, the circuit board having a coating applied on top of the plurality of LED light sources to form an LED unit to eliminate bright spots and provide at least substantially even brightness;

at least one DC battery arranged within the LED light bar; and wherein at least one light beam from the plurality of LED light sources is emitted out to a viewer through the coating and at least one of a top, front, side, or outer lens with or without being reflected within inner parts or an inner surface of the light bar, wherein the LED light bar further includes at least one of (1) a switch, (2) a sensor, (3) a wireless system, and (4) a control circuit to operate the light bar, wherein the at least one magnetic piece and the at least one metal piece separately fit within a non-heat sink base and the light bar, and wherein the non-heat sink base and the light bar have complementary curved surfaces that slidably engage each other in response to attraction between the at least one magnetic piece and the at least one metal piece to:

(i) enable a change in light beam emitting angle of the LED light bar by rotating the light bar relative to the base, and (ii) enable a change in position of the light beam by linearly sliding the light bar relative to the base, and wherein the non-heat sink base is installed on a surface by at least one of an adhesive piece, installation kit, and magnetic kit.

2. A DC battery powered LED light-bar, comprising:

a plurality of LED light sources on a circuit board included in the LED light bar, the circuit board having a coating applied on top of the plurality of LED light sources to form an LED unit to eliminate bright spots and provide at least substantially even brightness; and at least one DC battery arranged within the LED light bar, wherein at least one light beam from the plurality of LED light sources is emitted out to a viewer through the coating and at least one of a top, front, side, or outer lens with or without being reflected within inner parts or an inner surface of the light bar, wherein the light bar has a length that is longer than a length of the base, and wherein the LED light bar includes:

(A) a magnetic assembly that provides magnetic attraction between at least one metal piece or metal battery case fitted within the light bar and at least one magnetic piece fitted within a separate plastic injected base; and (B) at least one of an adhesive tape, foam tape, Velcro tape, glue, screw, nail, rivet, fastener, holder, magnet, and attachment kit to hold the base to a surface or under a cabinet, and wherein the light bar and the separate plastic injected base include complementary surfaces that movably engage each other as a result of the magnetic attraction provided by the magnetic assembly, to enable linear sliding movement and rotation of the light bar relative to the base and therefore change a position and orientation of the at least one light beam emitted out to a viewer.

3. A DC powered LED light bar as claimed in claim 1 or 2, wherein the metal piece is a metal body of a battery.

4. A DC powered LED light bar as claimed in claim 1 or 2, wherein the LED light bar includes more than one said LED unit.

5. A DC powered LED light bar as claimed in claim 2, wherein the LED light bar changes a light beam emitting direction by changing a light bar position or orientation on the base.

6. A DC powered LED light bar as claimed in claim 1 or 2, wherein the at least one LED unit includes at least one single or multiple color chip or dice incorporated with an integrated circuit and at least one switch to perform at least one of color changing, color selection, and color mixing effects controlled by an integrated circuit.

7. A DC powered LED light bar as claimed in claim 1, the control circuit includes or is incorporated with at least one of an integrated circuit, sensor, wireless system, and power fail detector to cause the LED light unit or light bar to achieve predetermined light effects, performance, or functions.

8. A DC powered LED light bar as claimed in claim 1 or 2, wherein the LED light unit or light bar has a predetermined geometric shape, brightness, color combination, flexibility, lumens, functions and coating color.

9. A DC powered LED light bar as claimed in claim 1 or 2, further including a wireless controller, wherein the wireless controller is, utilizes, or includes at least one of the following:

(i) IR or RF, (ii) Bluetooth, (iii) Zigbee, (iv) Z-way, (v) WiFi, (vi) a WiFi extender, (vii) a downloaded app, (viii) at least one photo or motion sensor, (ix) radar detection, (x) an Internet communication system, (xi) at least one of 3G, 4G, 5G, 6G and incoming higher level G, (x) wireless protocols other than the above-listed protocols, to set, adjust, change and/or select at least one of a desired color, brightness, duration, operation time period, sensor, distance, on/off, dynamite function, sequential function, light effect, and light performance.

10. A DC powered LED light bar as claimed in claim 1 or 2, wherein the LED light bar includes at least one function selected from:

(a) a color changing or selection function, (b) a sensor or brightness changing or adjustment function, (c) a dimming function, (d) a power fail, emergency, or evacuation light function, (e) a sensor actuated light function, (f) a light performance function selected from at least one of chasing, fade-in and fade-out, auto color changing, sequential activation, sound activation, and party lighting, (g) at least one additional function selected from at least one of:

(i) a USB or DC power input or output function, (ii) an AC power output function, (iii) a 10 W to 60 W USB quick charging function, (iv) a wireless receiving and transmitting function provided by a transmitter built-in at least one LED unit.

11. A DC powered LED light bar as claimed in claim 1 or 2, wherein the light bar has a tube, bar, pole, cylinder, polygon, or elongate shape.

12. A DC powered LED light bar as claimed in claim 1 or 2, wherein the LED light bar includes a remote controller for controlling at least one other said LED light bar.

13. ADC powered LED light bar as claimed in claim 1 or 2, wherein the LED light bar is installed on a surface of at least one of an under-cabinet, closet, cabinet, drawer, garage, patio, garden, fence, wall, table underside, bed underside, sofa underside, and chair underside, or on at least one an indoor or outdoor home surface.

14. A DC powered LED light bar as claimed in claim 1 or 2, wherein the LED light bar is powered by at least one of (i) a rechargeable or non-rechargeable battery, (ii) AC-to-DC transformer, (iii) USB input port and USB wire, (iv) external AC-to-DC transformer, and (v) energy storage unit of a solar, wind, or chemical power generating system.

15. A DC powered LED light bar as claimed in claim 1 or 2, wherein the LED light bar is a first light bar and includes a wireless receiver and transmitter configured to receive a first wireless signal from a second LED light bar to operate predetermined functions of the first LED light bar, and to transmit a second wireless signal to a third or fourth LED light bar located within a signal transmission range of the first LED light bar and beyond a signal transmission range of the second LED light bar to operate predetermined functions of the third or fourth LED light bar and provide LED light bar control over a large indoor, outdoor, home, or garden area.

* * * * *